US008421366B2

(12) United States Patent
Palazzolo et al.

(10) Patent No.: US 8,421,366 B2
(45) Date of Patent: Apr. 16, 2013

(54) ILLUMINATION DEVICE INCLUDING LEDS AND A SWITCHING POWER CONTROL SYSTEM

(75) Inventors: Francis Palazzolo, Rochester, MI (US); John Ivey, Farmington Hills, MI (US)

(73) Assignee: ilumisys, Inc., Troy, MI (US)

( * ) Notice: Subject to any disclaimer, the term of this patent is extended or adjusted under 35 U.S.C. 154(b) by 429 days.

(21) Appl. No.: 12/821,769

(22) Filed: Jun. 23, 2010

(65) Prior Publication Data

US 2010/0320922 A1 Dec. 23, 2010

Related U.S. Application Data

(60) Provisional application No. 61/219,627, filed on Jun. 23, 2009.

(51) Int. Cl.
*H05B 37/02* (2006.01)

(52) U.S. Cl.
USPC ..... 315/224; 315/291; 315/307

(58) Field of Classification Search ..... 315/291, 315/307, 308, 209 R, 224, 227 R, 240, 241 R, 315/242, 246
See application file for complete search history.

(56) References Cited

U.S. PATENT DOCUMENTS

| | | | |
|---|---|---|---|
| D54,511 | S | 2/1920 | Owen |
| D58,105 | S | 6/1921 | Poritz |
| D79,814 | S | 11/1929 | Hoch |
| D80,419 | S | 1/1930 | Kramer |
| D84,763 | S | 7/1931 | Stange |
| D119,797 | S | 4/1940 | Winkler et al. |
| D125,312 | S | 2/1941 | Logan |
| 2,909,097 | A | 10/1959 | Alden et al. |
| 3,318,185 | A | 5/1967 | Kott |
| 3,561,719 | A | 2/1971 | Grindle |
| 3,586,936 | A | 6/1971 | McLeroy |
| 3,601,621 | A | 8/1971 | Ritchie |

(Continued)

FOREIGN PATENT DOCUMENTS

| | | | |
|---|---|---|---|
| CN | 1584388 | A | 2/2005 |
| CN | 2766345 | Y | 3/2006 |

(Continued)

OTHER PUBLICATIONS

Notification of Transmittal, International Search Report and Written Opinion of the International Searching Authority from the corresponding International Application No. PCT/US2010/039678 dated Feb. 7, 2011.

(Continued)

*Primary Examiner* — David H Vu
(74) *Attorney, Agent, or Firm* — Young Basile

(57) ABSTRACT

Disclosed herein is an illumination device including light-emitting diodes, an alternating current input, a full-wave rectifier coupled to the alternating current input and configured to produce a rectified voltage output and a power converter, the power converter having a switching element electrically coupled to the rectified voltage output of the full-wave rectifier. An improvement of the illumination device includes a feedback circuit configured to determine an average current across the light-emitting diodes and to invert a signal representing the average current to provide a switching signal to the switching element such that, for a range of operating points, increasing a current drawn into the power converter will decrease LED power and decreasing the current drawn into the power converter will increase LED power.

17 Claims, 7 Drawing Sheets

U.S. PATENT DOCUMENTS

| | | | |
|---|---|---|---|
| 3,612,855 | A | 10/1971 | Juhnke |
| 3,643,088 | A | 2/1972 | Osteen et al. |
| 3,746,918 | A | 7/1973 | Drucker et al. |
| 3,818,216 | A | 6/1974 | Larraburu |
| 3,832,503 | A | 8/1974 | Crane |
| 3,858,086 | A | 12/1974 | Anderson et al. |
| 3,909,670 | A | 9/1975 | Wakamatsu et al. |
| 3,924,120 | A | 12/1975 | Cox, III |
| 3,958,885 | A | 5/1976 | Stockinger et al. |
| 3,974,637 | A | 8/1976 | Bergey et al. |
| 3,993,386 | A | 11/1976 | Rowe |
| 4,001,571 | A | 1/1977 | Martin |
| 4,054,814 | A | 10/1977 | Fegley et al. |
| 4,070,568 | A | 1/1978 | Gala |
| 4,082,395 | A | 4/1978 | Donato et al. |
| 4,096,349 | A | 6/1978 | Donato |
| 4,102,558 | A | 7/1978 | Krachman |
| 4,107,581 | A | 8/1978 | Abernethy |
| 4,189,663 | A | 2/1980 | Schmutzer et al. |
| 4,211,955 | A | 7/1980 | Ray |
| 4,241,295 | A | 12/1980 | Williams, Jr. |
| 4,271,408 | A | 6/1981 | Teshima et al. |
| 4,272,689 | A | 6/1981 | Crosby et al. |
| 4,273,999 | A | 6/1981 | Pierpoint |
| 4,298,869 | A | 11/1981 | Okuno |
| 4,329,625 | A | 5/1982 | Nishizawa et al. |
| 4,339,788 | A | 7/1982 | White et al. |
| 4,342,947 | A | 8/1982 | Bloyd |
| 4,367,464 | A | 1/1983 | Kurahashi et al. |
| D268,134 | S | 3/1983 | Zurcher |
| 4,382,272 | A | 5/1983 | Quella et al. |
| 4,388,567 | A | 6/1983 | Yamazaki et al. |
| 4,388,589 | A | 6/1983 | Molldrem, Jr. |
| 4,392,187 | A | 7/1983 | Bornhorst |
| 4,394,719 | A | 7/1983 | Moberg |
| 4,420,711 | A | 12/1983 | Takahashi et al. |
| 4,455,562 | A | 6/1984 | Dolan et al. |
| 4,500,796 | A | 2/1985 | Quin |
| 4,581,687 | A | 4/1986 | Nakanishi |
| 4,597,033 | A | 6/1986 | Meggs et al. |
| 4,600,972 | A | 7/1986 | MacIntyre |
| 4,607,317 | A | 8/1986 | Lin |
| 4,622,881 | A | 11/1986 | Rand |
| 4,625,152 | A | 11/1986 | Nakai |
| 4,635,052 | A | 1/1987 | Aoike et al. |
| 4,647,217 | A | 3/1987 | Havel |
| 4,656,398 | A | 4/1987 | Michael et al. |
| 4,661,890 | A | 4/1987 | Watanabe et al. |
| 4,668,895 | A | 5/1987 | Schneiter |
| 4,675,575 | A | 6/1987 | Smith et al. |
| 4,682,079 | A | 7/1987 | Sanders et al. |
| 4,686,425 | A | 8/1987 | Havel |
| 4,687,340 | A | 8/1987 | Havel |
| 4,688,154 | A | 8/1987 | Nilssen |
| 4,688,869 | A | 8/1987 | Kelly |
| 4,695,769 | A | 9/1987 | Schweickardt |
| 4,698,730 | A | 10/1987 | Sakai et al. |
| 4,701,669 | A | 10/1987 | Head et al. |
| 4,705,406 | A | 11/1987 | Havel |
| 4,707,141 | A | 11/1987 | Havel |
| D293,723 | S | 1/1988 | Buttner |
| 4,727,289 | A | 2/1988 | Uchida |
| 4,740,882 | A | 4/1988 | Miller |
| 4,748,545 | A | 5/1988 | Schmitt |
| 4,753,148 | A | 6/1988 | Johnson |
| 4,758,173 | A | 7/1988 | Northrop |
| 4,771,274 | A | 9/1988 | Havel |
| 4,780,621 | A | 10/1988 | Bartleucci et al. |
| 4,794,383 | A | 12/1988 | Havel |
| 4,810,937 | A | 3/1989 | Havel |
| 4,818,072 | A | 4/1989 | Mohebban |
| 4,824,269 | A | 4/1989 | Havel |
| 4,837,565 | A | 6/1989 | White |
| 4,843,627 | A | 6/1989 | Stebbins |
| 4,845,481 | A | 7/1989 | Havel |
| 4,845,745 | A | 7/1989 | Havel |
| 4,857,801 | A | 8/1989 | Farrell |
| 4,863,223 | A | 9/1989 | Weissenbach et al. |
| 4,870,325 | A | 9/1989 | Kazar |
| 4,874,320 | A | 10/1989 | Freed et al. |
| 4,887,074 | A | 12/1989 | Simon et al. |
| 4,894,832 | A | 1/1990 | Colak |
| 4,901,207 | A | 2/1990 | Sato et al. |
| 4,912,371 | A | 3/1990 | Hamilton |
| 4,922,154 | A | 5/1990 | Cacoub |
| 4,934,852 | A | 6/1990 | Havel |
| 4,941,072 | A | 7/1990 | Yasumoto et al. |
| 4,943,900 | A | 7/1990 | Gartner |
| 4,962,687 | A | 10/1990 | Belliveau et al. |
| 4,965,561 | A | 10/1990 | Havel |
| 4,973,835 | A | 11/1990 | Kurosu et al. |
| 4,979,081 | A | 12/1990 | Leach et al. |
| 4,980,806 | A | 12/1990 | Taylor et al. |
| 4,992,704 | A | 2/1991 | Stinson |
| 5,003,227 | A | 3/1991 | Nilssen |
| 5,008,595 | A | 4/1991 | Kazar |
| 5,008,788 | A | 4/1991 | Palinkas |
| 5,010,459 | A | 4/1991 | Taylor et al. |
| 5,018,054 | A | 5/1991 | Ohashi et al. |
| 5,027,037 | A | 6/1991 | Wei |
| 5,027,262 | A | 6/1991 | Freed |
| 5,032,960 | A | 7/1991 | Katoh |
| 5,034,807 | A | 7/1991 | Von Kohorn |
| 5,036,248 | A | 7/1991 | McEwan et al. |
| 5,038,255 | A | 8/1991 | Nishihashi et al. |
| 5,065,226 | A | 11/1991 | Kluitmans et al. |
| 5,072,216 | A | 12/1991 | Grange |
| 5,078,039 | A | 1/1992 | Tulk et al. |
| 5,083,063 | A | 1/1992 | Brooks |
| 5,088,013 | A | 2/1992 | Revis |
| 5,089,748 | A | 2/1992 | Ihms |
| 5,103,382 | A | 4/1992 | Kondo et al. |
| 5,122,733 | A | 6/1992 | Havel |
| 5,126,634 | A | 6/1992 | Johnson |
| 5,128,595 | A | 7/1992 | Hara |
| 5,130,909 | A | 7/1992 | Gross |
| 5,134,387 | A | 7/1992 | Smith et al. |
| 5,140,220 | A | 8/1992 | Hasegawa |
| 5,142,199 | A | 8/1992 | Elwell |
| 5,151,679 | A | 9/1992 | Dimmick |
| 5,154,641 | A | 10/1992 | McLaughlin |
| 5,161,879 | A | 11/1992 | McDermott |
| 5,161,882 | A | 11/1992 | Garrett |
| 5,164,715 | A | 11/1992 | Kashiwabara et al. |
| 5,184,114 | A | 2/1993 | Brown |
| 5,194,854 | A | 3/1993 | Havel |
| 5,198,756 | A | 3/1993 | Jenkins et al. |
| 5,209,560 | A | 5/1993 | Taylor et al. |
| 5,220,250 | A | 6/1993 | Szuba |
| 5,225,765 | A | 7/1993 | Callahan et al. |
| 5,226,723 | A | 7/1993 | Chen |
| 5,254,910 | A | 10/1993 | Yang |
| 5,256,948 | A | 10/1993 | Boldin et al. |
| 5,278,542 | A | 1/1994 | Smith et al. |
| 5,282,121 | A | 1/1994 | Bornhorst et al. |
| 5,283,517 | A | 2/1994 | Havel |
| 5,287,352 | A | 2/1994 | Jackson et al. |
| 5,294,865 | A | 3/1994 | Haraden |
| 5,298,871 | A | 3/1994 | Shimohara |
| 5,301,090 | A | 4/1994 | Hed |
| 5,303,124 | A | 4/1994 | Wrobel |
| 5,307,295 | A | 4/1994 | Taylor et al. |
| 5,321,593 | A | 6/1994 | Moates |
| 5,323,226 | A | 6/1994 | Schreder |
| 5,329,431 | A | 7/1994 | Taylor et al. |
| 5,344,068 | A | 9/1994 | Haessig |
| 5,350,977 | A | 9/1994 | Hamamoto et al. |
| 5,357,170 | A | 10/1994 | Luchaco et al. |
| 5,371,618 | A | 12/1994 | Tai et al. |
| 5,374,876 | A | 12/1994 | Horibata et al. |
| 5,375,043 | A | 12/1994 | Tokunaga |
| D354,360 | S | 1/1995 | Murata |
| 5,381,074 | A | 1/1995 | Rudzewicz et al. |
| 5,388,357 | A | 2/1995 | Malita |
| 5,402,702 | A | 4/1995 | Hata |
| 5,404,282 | A | 4/1995 | Klinke et al. |
| 5,406,176 | A | 4/1995 | Sugden |

5,410,328 A 4/1995 Yoksza et al.
5,412,284 A 5/1995 Moore et al.
5,412,552 A 5/1995 Fernandes
5,420,482 A 5/1995 Phares
5,421,059 A 6/1995 Leffers, Jr.
5,430,356 A 7/1995 Ference et al.
5,432,408 A 7/1995 Matsuda et al.
5,436,535 A 7/1995 Yang
5,436,853 A 7/1995 Shimohara
5,450,301 A 9/1995 Waltz et al.
5,461,188 A 10/1995 Drago et al.
5,463,280 A 10/1995 Johnson
5,463,502 A 10/1995 Savage, Jr.
5,465,144 A 11/1995 Parker et al.
5,475,300 A 12/1995 Havel
5,489,827 A 2/1996 Xia
5,491,402 A 2/1996 Small
5,493,183 A 2/1996 Kimball
5,504,395 A 4/1996 Johnson et al.
5,506,760 A 4/1996 Giebler et al.
5,513,082 A 4/1996 Asano
5,519,496 A 5/1996 Borgert et al.
5,530,322 A 6/1996 Ference et al.
5,544,809 A 8/1996 Keating et al.
5,545,950 A 8/1996 Cho
5,550,440 A 8/1996 Allison et al.
5,559,681 A 9/1996 Duarte
5,561,346 A 10/1996 Byrne
D376,030 S 11/1996 Cohen
5,575,459 A 11/1996 Anderson
5,575,554 A 11/1996 Guritz
5,581,158 A 12/1996 Quazi
5,592,051 A 1/1997 Korkala
5,592,054 A 1/1997 Nerone et al.
5,600,199 A 2/1997 Martin, Sr. et al.
5,607,227 A 3/1997 Yasumoto et al.
5,608,290 A 3/1997 Hutchisson et al.
5,614,788 A 3/1997 Mullins et al.
5,621,282 A 4/1997 Haskell
5,621,603 A 4/1997 Adamec et al.
5,621,662 A 4/1997 Humphries et al.
5,622,423 A 4/1997 Lee
5,633,629 A 5/1997 Hochstein
5,634,711 A 6/1997 Kennedy et al.
5,640,061 A 6/1997 Bornhorst et al.
5,640,141 A 6/1997 Myllymaki
5,642,129 A 6/1997 Zavracky et al.
5,655,830 A 8/1997 Ruskouski
5,656,935 A 8/1997 Havel
5,661,645 A 8/1997 Hochstein
5,673,059 A 9/1997 Zavracky et al.
5,682,103 A 10/1997 Burrell
5,688,042 A 11/1997 Madadi et al.
5,697,695 A 12/1997 Lin et al.
5,701,058 A 12/1997 Roth
5,712,650 A 1/1998 Barlow
5,721,471 A 2/1998 Begemann et al.
5,725,148 A 3/1998 Hartman
5,726,535 A 3/1998 Yan
5,731,759 A 3/1998 Finucan
5,734,590 A 3/1998 Tebbe
5,751,118 A 5/1998 Mortimer
5,752,766 A 5/1998 Bailey et al.
5,765,940 A 6/1998 Levy et al.
5,769,527 A 6/1998 Taylor et al.
5,784,006 A 7/1998 Hochstein
5,785,227 A 7/1998 Akiba
5,790,329 A 8/1998 Klaus et al.
5,803,579 A 9/1998 Turnbull et al.
5,803,580 A 9/1998 Tseng
5,803,729 A 9/1998 Tsimerman
5,806,965 A 9/1998 Deese
5,808,689 A 9/1998 Small
5,810,463 A 9/1998 Kawahara et al.
5,812,105 A 9/1998 Van de Ven
5,813,751 A 9/1998 Shaffer
5,813,753 A 9/1998 Vriens et al.
5,821,695 A 10/1998 Vilanilam et al.
5,825,051 A 10/1998 Bauer et al.
5,828,178 A 10/1998 York et al.
5,836,676 A 11/1998 Ando et al.
5,848,837 A 12/1998 Gustafson
5,850,126 A 12/1998 Kanbar
5,851,063 A 12/1998 Doughty et al.
5,852,658 A 12/1998 Knight et al.
5,854,542 A 12/1998 Forbes
RE36,030 E 1/1999 Nadeau
5,859,508 A 1/1999 Ge et al.
5,865,529 A 2/1999 Yan
5,890,794 A 4/1999 Abtahi et al.
5,896,010 A 4/1999 Mikolajczak et al.
5,907,742 A 5/1999 Johnson et al.
5,912,653 A 6/1999 Fitch
5,921,660 A 7/1999 Yu
5,924,784 A 7/1999 Chliwnyj et al.
5,927,845 A 7/1999 Gustafson et al.
5,934,792 A 8/1999 Camarota
5,943,802 A 8/1999 Tijanic
5,946,209 A 8/1999 Eckel et al.
5,949,347 A 9/1999 Wu
5,952,680 A 9/1999 Strite
5,959,547 A 9/1999 Tubel et al.
5,962,989 A 10/1999 Baker
5,962,992 A 10/1999 Huang et al.
5,963,185 A 10/1999 Havel
5,974,553 A 10/1999 Gandar
5,980,064 A 11/1999 Metroyanis
5,998,925 A 12/1999 Shimizu et al.
5,998,928 A 12/1999 Hipp
6,007,209 A 12/1999 Pelka
6,008,783 A 12/1999 Kitagawa et al.
6,011,691 A 1/2000 Schreffler
6,016,038 A 1/2000 Mueller et al.
6,018,237 A 1/2000 Havel
6,019,493 A 2/2000 Kuo et al.
6,020,825 A 2/2000 Chansky et al.
6,025,550 A 2/2000 Kato
6,028,694 A 2/2000 Schmidt
6,030,099 A 2/2000 McDermott
6,031,343 A 2/2000 Recknagel et al.
D422,737 S 4/2000 Orozco
6,056,420 A 5/2000 Wilson et al.
6,068,383 A 5/2000 Robertson et al.
6,069,597 A 5/2000 Hansen
6,072,280 A 6/2000 Allen
6,084,359 A 7/2000 Hetzel et al.
6,086,220 A 7/2000 Lash et al.
6,091,200 A 7/2000 Lenz
6,092,915 A 7/2000 Rensch
6,095,661 A 8/2000 Lebens et al.
6,097,352 A 8/2000 Zavracky et al.
6,116,748 A 9/2000 George
6,121,875 A 9/2000 Hamm et al.
6,127,783 A 10/2000 Pashley et al.
6,132,072 A 10/2000 Turnbull et al.
6,135,604 A 10/2000 Lin
6,139,174 A 10/2000 Butterworth
6,149,283 A 11/2000 Conway et al.
6,150,774 A 11/2000 Mueller et al.
6,151,529 A 11/2000 Batko
6,158,882 A 12/2000 Bischoff, Jr.
6,166,496 A 12/2000 Lys et al.
6,175,201 B1 1/2001 Sid
6,175,220 B1 1/2001 Billig et al.
6,181,126 B1 1/2001 Havel
6,183,086 B1 2/2001 Neubert
6,183,104 B1 2/2001 Ferrara
6,184,628 B1 2/2001 Ruthenberg
6,196,471 B1 3/2001 Ruthenberg
6,203,180 B1 3/2001 Fleischmann
6,211,626 B1 4/2001 Lys et al.
6,215,409 B1 4/2001 Blach
6,217,190 B1 4/2001 Altman et al.
6,219,239 B1 4/2001 Mellberg et al.
6,227,679 B1 5/2001 Zhang et al.
6,238,075 B1 5/2001 Dealey, Jr. et al.
6,241,359 B1 6/2001 Lin
6,250,774 B1 6/2001 Begemann et al.

6,252,350 B1 6/2001 Alvarez
6,252,358 B1 6/2001 Xydis et al.
6,268,600 B1 7/2001 Nakamura et al.
6,273,338 B1 8/2001 White
6,275,397 B1 8/2001 McClain
6,283,612 B1 9/2001 Hunter
6,292,901 B1 9/2001 Lys et al.
6,293,684 B1 9/2001 Riblett
6,297,724 B1 10/2001 Bryans et al.
6,305,109 B1 10/2001 Lee
6,305,821 B1 10/2001 Hsieh et al.
6,307,331 B1 10/2001 Bonasia et al.
6,310,590 B1 10/2001 Havel
6,323,832 B1 11/2001 Nishizawa et al.
6,325,651 B1 12/2001 Nishihara et al.
6,334,699 B1 1/2002 Gladnick
6,340,868 B1 1/2002 Lys et al.
6,354,714 B1 3/2002 Rhodes
6,361,186 B1 3/2002 Slayden
6,369,525 B1 4/2002 Chang et al.
6,371,637 B1 4/2002 Atchinson et al.
6,379,022 B1 4/2002 Amerson et al.
D457,667 S 5/2002 Piepgras et al.
D457,669 S 5/2002 Piepgras et al.
D457,974 S 5/2002 Piepgras et al.
6,388,393 B1 5/2002 Illingworth
6,394,623 B1 5/2002 Tsui
D458,395 S 6/2002 Piepgras et al.
6,400,096 B1 6/2002 Wells et al.
6,404,131 B1 6/2002 Kawano et al.
6,411,022 B1 6/2002 Machida
6,422,716 B2 7/2002 Henrici et al.
6,428,189 B1 8/2002 Hochstein
6,429,604 B1 8/2002 Chang
D463,610 S 9/2002 Piepgras et al.
6,445,139 B1 9/2002 Marshall et al.
6,448,550 B1 9/2002 Nishimura
6,448,716 B1 9/2002 Hutchison
6,459,919 B1 10/2002 Lys et al.
6,469,457 B2 10/2002 Callahan
6,471,388 B1 10/2002 Marsh
6,472,823 B2 10/2002 Yen
6,473,002 B1 10/2002 Hutchison
D468,035 S 12/2002 Blanc et al.
6,488,392 B1 12/2002 Lu
6,495,964 B1 12/2002 Muthu et al.
6,527,411 B1 3/2003 Sayers
6,528,954 B1 3/2003 Lys et al.
6,528,958 B2 3/2003 Hulshof et al.
6,538,375 B1 3/2003 Duggal et al.
6,548,967 B1 4/2003 Dowling et al.
6,568,834 B1 5/2003 Scianna
6,573,536 B1 6/2003 Dry
6,577,072 B2 6/2003 Saito et al.
6,577,080 B2 6/2003 Lys et al.
6,577,512 B2 6/2003 Tripathi et al.
6,577,794 B1 6/2003 Currie et al.
6,578,979 B2 6/2003 Truttmann-Battig
6,582,103 B1 6/2003 Popovich et al.
6,583,550 B2 6/2003 Iwasa et al.
6,583,573 B2 6/2003 Bierman
6,585,393 B1 7/2003 Brandes et al.
6,586,890 B2 7/2003 Min et al.
6,590,343 B2 7/2003 Pederson
6,592,238 B2 7/2003 Cleaver et al.
6,596,977 B2 7/2003 Muthu et al.
6,598,996 B1 7/2003 Lodhie
6,608,453 B2 8/2003 Morgan et al.
6,608,614 B1 8/2003 Johnson
6,609,804 B2 8/2003 Nolan et al.
6,612,712 B2 9/2003 Nepil
6,612,717 B2 9/2003 Yen
6,621,222 B1 9/2003 Hong
6,623,151 B2 9/2003 Pederson
6,624,597 B2 9/2003 Dowling et al.
D481,484 S 10/2003 Cuevas et al.
6,634,770 B2 10/2003 Cao
6,634,779 B2 10/2003 Reed
6,636,003 B2 10/2003 Rahm et al.
6,639,349 B1 10/2003 Bahadur
6,641,284 B2 11/2003 Stopa et al.
6,659,622 B2 12/2003 Katogi et al.
6,660,935 B2 12/2003 Southard et al.
6,666,689 B1 12/2003 Savage, Jr.
6,667,623 B2 12/2003 Bourgault et al.
6,674,096 B2 1/2004 Sommers
6,676,284 B1 1/2004 Wynne Willson
6,679,621 B2 1/2004 West et al.
6,681,154 B2 1/2004 Nierlich et al.
6,682,205 B2 1/2004 Lin
6,683,419 B2 1/2004 Kriparos
6,700,136 B2 3/2004 Guida
6,712,486 B1 3/2004 Popovich et al.
6,717,376 B2 4/2004 Lys et al.
6,717,526 B2 4/2004 Martineau et al.
6,720,745 B2 4/2004 Lys et al.
6,726,348 B2 4/2004 Gloisten
6,741,324 B1 5/2004 Kim
D491,678 S 6/2004 Piepgras
D492,042 S 6/2004 Piepgras
6,744,223 B2 6/2004 Laflamme et al.
6,748,299 B1 6/2004 Motoyama
6,762,562 B2 7/2004 Leong
6,774,584 B2 8/2004 Lys et al.
6,777,891 B2 8/2004 Lys et al.
6,781,329 B2 8/2004 Mueller et al.
6,787,999 B2 9/2004 Stimac et al.
6,788,000 B2 9/2004 Appelberg et al.
6,788,011 B2 9/2004 Mueller et al.
6,791,840 B2 9/2004 Chun
6,796,680 B1 9/2004 Showers et al.
6,801,003 B2 10/2004 Schanberger et al.
6,806,659 B1 10/2004 Mueller et al.
6,814,470 B2 11/2004 Rizkin et al.
6,815,724 B2 11/2004 Dry
6,846,094 B2 1/2005 Luk
6,851,816 B2 2/2005 Wu et al.
6,851,832 B2 2/2005 Tieszen
6,853,151 B2 2/2005 Leong et al.
6,853,563 B1 2/2005 Yang et al.
6,857,924 B2 2/2005 Fu et al.
6,860,628 B2 3/2005 Robertson et al.
6,866,401 B2 3/2005 Sommers et al.
6,869,204 B2 3/2005 Morgan et al.
6,871,981 B2 3/2005 Alexanderson et al.
6,874,924 B1 4/2005 Hulse et al.
6,879,883 B1 4/2005 Motoyama
6,882,111 B2 4/2005 Kan et al.
6,883,929 B2 4/2005 Dowling
6,883,934 B2 4/2005 Kawakami et al.
6,888,322 B2 5/2005 Dowling et al.
6,897,624 B2 5/2005 Lys et al.
6,909,239 B2 6/2005 Gauna
6,909,921 B1 6/2005 Bilger
6,918,680 B2 7/2005 Seeberger
6,921,181 B2 7/2005 Yen
6,936,968 B2 8/2005 Cross et al.
6,936,978 B2 8/2005 Morgan et al.
6,940,230 B2 9/2005 Myron et al.
6,948,829 B2 9/2005 Verdes et al.
6,957,905 B1 10/2005 Pritvchard et al.
6,963,175 B2 11/2005 Archenhold et al.
6,964,501 B2 11/2005 Ryan
6,965,197 B2 11/2005 Tyan et al.
6,965,205 B2 11/2005 Piepgras et al.
6,967,448 B2 11/2005 Morgan et al.
6,969,179 B2 11/2005 Sloan et al.
6,969,186 B2 11/2005 Sonderegger et al.
6,969,954 B2 11/2005 Lys
6,975,079 B2 12/2005 Lys et al.
6,979,097 B2 12/2005 Elam et al.
6,982,518 B2 1/2006 Chou et al.
6,995,681 B2 2/2006 Pederson
6,997,576 B1 2/2006 Lodhie et al.
7,004,603 B2 2/2006 Knight
D518,218 S 3/2006 Roberge et al.
7,008,079 B2 3/2006 Smith
7,014,336 B1 3/2006 Ducharme et al.

7,015,650 B2 3/2006 McGrath
7,018,063 B2 3/2006 Michael et al.
7,021,799 B2 4/2006 Mizuyoshi
7,021,809 B2 4/2006 Iwasa et al.
7,024,256 B2 4/2006 Krzyzanowski et al.
7,031,920 B2 4/2006 Dowling et al.
7,033,036 B2 4/2006 Pederson
7,038,398 B1 5/2006 Lys et al.
7,038,399 B2 5/2006 Lys et al.
7,042,172 B2 5/2006 Dowling et al.
7,048,423 B2 5/2006 Stepanenko et al.
7,049,761 B2 5/2006 Timmermans et al.
7,052,171 B1 5/2006 Lefebvre et al.
7,053,557 B2 5/2006 Cross et al.
7,064,498 B2 6/2006 Dowling et al.
7,064,674 B2 6/2006 Pederson
7,067,992 B2 6/2006 Leong et al.
7,077,978 B2 7/2006 Setlur et al.
7,080,927 B2 7/2006 Feuerborn et al.
7,086,747 B2 8/2006 Nielson et al.
7,088,014 B2 8/2006 Nierlich et al.
7,088,904 B2 8/2006 Ryan, Jr.
7,102,902 B1 9/2006 Brown et al.
7,113,541 B1 9/2006 Lys et al.
7,114,830 B2 10/2006 Robertson et al.
7,114,834 B2 10/2006 Rivas et al.
7,118,262 B2 10/2006 Negley
7,119,503 B2 10/2006 Kemper
7,121,679 B2 10/2006 Fujimoto
7,122,976 B1 10/2006 Null et al.
7,128,442 B2 10/2006 Lee et al.
7,128,454 B2 10/2006 Kim et al.
D532,532 S 11/2006 Maxik
7,132,635 B2 11/2006 Dowling
7,132,785 B2 11/2006 Ducharme
7,132,804 B2 11/2006 Lys et al.
7,135,824 B2 11/2006 Lys et al.
7,139,617 B1 11/2006 Morgan et al.
7,144,135 B2 12/2006 Martin et al.
7,153,002 B2 12/2006 Kim et al.
7,161,311 B2 1/2007 Mueller et al.
7,161,313 B2 1/2007 Piepgras et al.
7,161,556 B2 1/2007 Morgan et al.
7,164,110 B2 1/2007 Pitigoi-Aron et al.
7,164,235 B2 1/2007 Ito et al.
7,165,863 B1 1/2007 Thomas et al.
7,165,866 B2 1/2007 Li
7,167,777 B2 1/2007 Budike, Jr.
7,168,843 B2 1/2007 Striebel
D536,468 S 2/2007 Crosby
7,178,941 B2 2/2007 Roberge et al.
7,180,252 B2 2/2007 Lys et al.
D538,950 S 3/2007 Maxik
D538,952 S 3/2007 Maxik et al.
D538,962 S 3/2007 Elliott
7,186,003 B2 3/2007 Dowling et al.
7,186,005 B2 3/2007 Hulse
7,187,141 B2 3/2007 Mueller et al.
7,190,126 B1 3/2007 Paton
7,192,154 B2 3/2007 Becker
7,198,387 B1 4/2007 Gloisten et al.
7,201,491 B2 4/2007 Bayat et al.
7,201,497 B2 4/2007 Weaver, Jr. et al.
7,202,613 B2 4/2007 Morgan et al.
7,204,615 B2 4/2007 Arik et al.
7,204,622 B2 4/2007 Dowling et al.
7,207,696 B1 4/2007 Lin
7,210,818 B2 5/2007 Luk et al.
7,210,957 B2 5/2007 Mrakovich
7,211,959 B1 5/2007 Chou
7,213,934 B2 5/2007 Zarian et al.
7,217,004 B2 5/2007 Park et al.
7,217,012 B2 5/2007 Southard et al.
7,217,022 B2 5/2007 Ruffin
7,218,056 B1 5/2007 Harwood
7,218,238 B2 5/2007 Right et al.
7,220,015 B2 5/2007 Dowling
7,220,018 B2 5/2007 Crabb et al.
7,221,104 B2 5/2007 Lys et al.
7,221,110 B2 5/2007 Sears et al.
7,224,000 B2 5/2007 Aanegola et al.
7,226,189 B2 6/2007 Lee et al.
7,228,052 B1 6/2007 Lin
7,228,190 B2 6/2007 Dowling et al.
7,231,060 B2 6/2007 Dowling et al.
7,233,115 B2 6/2007 Lys
7,233,831 B2 6/2007 Blackwell
7,236,366 B2 6/2007 Chen
7,237,924 B2 7/2007 Martineau et al.
7,237,925 B2 7/2007 Mayer et al.
7,239,532 B1 7/2007 Hsu et al.
7,241,038 B2 7/2007 Naniwa et al.
7,242,152 B2 7/2007 Dowling et al.
7,246,926 B2 7/2007 Harwood
7,246,931 B2 7/2007 Hsieh et al.
7,248,239 B2 7/2007 Dowling et al.
7,249,269 B1 7/2007 Motoyama
7,249,865 B2 7/2007 Robertson
D548,868 S 8/2007 Roberge et al.
7,252,408 B2 8/2007 Mazzochette et al.
7,253,566 B2 8/2007 Lys et al.
7,255,457 B2 8/2007 Ducharme et al.
7,255,460 B2 8/2007 Lee
7,256,554 B2 8/2007 Lys
7,258,458 B2 8/2007 Mochiachvili et al.
7,258,467 B2 8/2007 Saccomanno et al.
7,259,528 B2 8/2007 Pilz
7,262,439 B2 8/2007 Setlur et al.
7,262,559 B2 8/2007 Tripathi et al.
7,264,372 B2 9/2007 Maglica
7,267,467 B2 9/2007 Wu et al.
7,270,443 B2 9/2007 Kurtz et al.
7,271,794 B1 9/2007 Cheng et al.
7,273,300 B2 9/2007 Mrakovich
7,274,045 B2 9/2007 Chandran et al.
7,274,160 B2 9/2007 Mueller et al.
D553,267 S 10/2007 Yuen
7,285,801 B2 10/2007 Eliashevich et al.
7,288,902 B1 10/2007 Melanson
7,296,912 B2 11/2007 Beauchamp
7,300,184 B2 11/2007 Ichikawa et al.
7,300,192 B2 11/2007 Mueller et al.
D556,937 S 12/2007 Ly
D557,854 S 12/2007 Lewis
7,303,300 B2 12/2007 Dowling et al.
7,306,353 B2 12/2007 Popovich et al.
7,307,391 B2 12/2007 Shan
7,308,296 B2 12/2007 Lys et al.
7,309,965 B2 12/2007 Dowling et al.
7,318,658 B2 1/2008 Wang et al.
7,319,244 B2 1/2008 Liu et al.
7,319,246 B2 1/2008 Soules et al.
7,321,191 B2 1/2008 Setlur et al.
7,326,964 B2 2/2008 Lim et al.
7,327,281 B2 2/2008 Hutchison
7,329,031 B2 2/2008 Liaw et al.
D563,589 S 3/2008 Hariri et al.
7,345,320 B2 3/2008 Dahm
7,348,604 B2 3/2008 Matheson
7,350,936 B2 4/2008 Ducharme et al.
7,350,952 B2 4/2008 Nishigaki
7,352,138 B2 4/2008 Lys et al.
7,352,339 B2 4/2008 Morgan et al.
7,353,071 B2 4/2008 Blackwell et al.
7,358,679 B2 4/2008 Lys et al.
7,358,929 B2 4/2008 Mueller et al.
7,374,327 B2 5/2008 Schexnaider
7,385,359 B2 6/2008 Dowling et al.
7,391,159 B2 6/2008 Harwood
7,396,146 B2 7/2008 Wang
7,401,935 B2 7/2008 VanderSchuit
7,401,945 B2 7/2008 Zhang
7,427,840 B2 9/2008 Morgan et al.
7,429,117 B2 9/2008 Pohlert et al.
7,434,964 B1 10/2008 Zheng et al.
7,438,441 B2 10/2008 Sun et al.
D580,089 S 11/2008 Ly et al.
D581,556 S 11/2008 To et al.

7,449,847 B2 11/2008 Schanberger et al.
D582,577 S 12/2008 Yuen
D584,428 S 1/2009 Li et al.
7,476,002 B2 1/2009 Wolf et al.
7,476,004 B2 1/2009 Chan
7,478,924 B2 1/2009 Robertson
D586,484 S 2/2009 Liu et al.
D586,928 S 2/2009 Liu et al.
7,490,957 B2 2/2009 Leong et al.
7,497,596 B2 3/2009 Ge
7,507,001 B2 3/2009 Kit
7,510,299 B2 3/2009 Timmermans et al.
7,520,635 B2 4/2009 Wolf et al.
7,521,872 B2 4/2009 Bruning
7,524,089 B2 4/2009 Park
D592,766 S 5/2009 Zhu et al.
D593,223 S 5/2009 Komar
7,534,002 B2 5/2009 Yamaguchi et al.
7,549,769 B2 6/2009 Kim et al.
7,556,396 B2 7/2009 Kuo et al.
7,572,030 B2 8/2009 Booth et al.
7,575,339 B2 8/2009 Hung
7,579,786 B2 8/2009 Soos
7,583,035 B2 * 9/2009 Shteynberg et al. ..... 315/307
7,602,559 B2 10/2009 Jang et al.
7,619,366 B2 11/2009 Diederiks
7,635,201 B2 12/2009 Deng
D612,528 S 3/2010 McGrath et al.
7,690,813 B2 4/2010 Kanamori et al.
7,712,918 B2 5/2010 Siemiet et al.
7,828,471 B2 11/2010 Lin
2001/0033488 A1 10/2001 Chliwnyj et al.
2001/0045803 A1 11/2001 Cencur
2002/0011801 A1 1/2002 Chang
2002/0038157 A1 3/2002 Dowling et al.
2002/0044066 A1 4/2002 Dowling et al.
2002/0047569 A1 4/2002 Dowling et al.
2002/0047624 A1 4/2002 Stam et al.
2002/0047628 A1 4/2002 Morgan et al.
2002/0048169 A1 4/2002 Dowling et al.
2002/0057061 A1 5/2002 Mueller et al.
2002/0060526 A1 5/2002 Timmermans et al.
2002/0070688 A1 6/2002 Dowling et al.
2002/0074559 A1 6/2002 Dowling et al.
2002/0078221 A1 6/2002 Blackwell et al.
2002/0101197 A1 8/2002 Lys et al.
2002/0113555 A1 8/2002 Lys et al.
2002/0130627 A1 9/2002 Morgan et al.
2002/0145394 A1 10/2002 Morgan et al.
2002/0145869 A1 10/2002 Dowling
2002/0152045 A1 10/2002 Dowling et al.
2002/0152298 A1 10/2002 Kikta et al.
2002/0153851 A1 10/2002 Morgan et al.
2002/0158583 A1 10/2002 Lys et al.
2002/0163316 A1 11/2002 Lys et al.
2002/0171365 A1 11/2002 Morgan et al.
2002/0171377 A1 11/2002 Mueller et al.
2002/0171378 A1 11/2002 Morgan et al.
2002/0176259 A1 11/2002 Ducharme
2002/0179816 A1 12/2002 Haines et al.
2002/0195975 A1 12/2002 Schanberger et al.
2003/0011538 A1 1/2003 Lys et al.
2003/0028260 A1 2/2003 Blackwell
2003/0031015 A1 2/2003 Ishibashi
2003/0057884 A1 3/2003 Dowling et al.
2003/0057886 A1 3/2003 Lys et al.
2003/0057887 A1 3/2003 Dowling et al.
2003/0057890 A1 3/2003 Lys et al.
2003/0076281 A1 4/2003 Morgan et al.
2003/0085710 A1 5/2003 Bourgault et al.
2003/0095404 A1 5/2003 Becks et al.
2003/0100837 A1 5/2003 Lys et al.
2003/0102810 A1 6/2003 Cross et al.
2003/0133292 A1 7/2003 Mueller et al.
2003/0137258 A1 7/2003 Piepgras et al.
2003/0185005 A1 10/2003 Sommers et al.
2003/0185014 A1 10/2003 Gloisten
2003/0189412 A1 10/2003 Cunningham
2003/0222587 A1 12/2003 Dowling, Jr. et al.
2004/0003545 A1 1/2004 Gillespie
2004/0012959 A1 1/2004 Robertson et al.
2004/0036006 A1 2/2004 Dowling
2004/0037088 A1 2/2004 English et al.
2004/0052076 A1 3/2004 Mueller et al.
2004/0062041 A1 4/2004 Cross et al.
2004/0075572 A1 4/2004 Buschmann et al.
2004/0080960 A1 4/2004 Wu
2004/0090191 A1 5/2004 Mueller et al.
2004/0090787 A1 5/2004 Dowling et al.
2004/0105261 A1 6/2004 Ducharme et al.
2004/0105264 A1 6/2004 Spero
2004/0113568 A1 6/2004 Dowling et al.
2004/0116039 A1 6/2004 Mueller et al.
2004/0124782 A1 7/2004 Yu
2004/0130909 A1 7/2004 Mueller et al.
2004/0141321 A1 7/2004 Dowling et al.
2004/0155609 A1 8/2004 Lys et al.
2004/0160199 A1 8/2004 Morgan et al.
2004/0178751 A1 9/2004 Mueller et al.
2004/0189218 A1 9/2004 Leong et al.
2004/0189262 A1 9/2004 McGrath
2004/0212320 A1 10/2004 Dowling et al.
2004/0212321 A1 10/2004 Lys et al.
2004/0212993 A1 10/2004 Morgan et al.
2004/0223328 A1 11/2004 Lee et al.
2004/0240890 A1 12/2004 Lys et al.
2004/0251854 A1 12/2004 Matsuda et al.
2004/0257007 A1 12/2004 Lys et al.
2005/0013133 A1 1/2005 Yeh
2005/0024877 A1 2/2005 Frederick
2005/0030744 A1 2/2005 Ducharme et al.
2005/0035728 A1 2/2005 Schanberger et al.
2005/0036300 A1 2/2005 Dowling et al.
2005/0040774 A1 2/2005 Mueller et al.
2005/0041161 A1 2/2005 Dowling et al.
2005/0041424 A1 2/2005 Ducharme
2005/0043907 A1 2/2005 Eckel et al.
2005/0044617 A1 3/2005 Mueller et al.
2005/0047132 A1 3/2005 Dowling et al.
2005/0047134 A1 3/2005 Mueller et al.
2005/0062440 A1 3/2005 Lys et al.
2005/0063194 A1 3/2005 Lys et al.
2005/0078477 A1 4/2005 Lo
2005/0099824 A1 5/2005 Dowling et al.
2005/0107694 A1 5/2005 Jansen et al.
2005/0110384 A1 5/2005 Peterson
2005/0116667 A1 6/2005 Mueller et al.
2005/0128751 A1 6/2005 Roberge et al.
2005/0141225 A1 6/2005 Striebel
2005/0151489 A1 7/2005 Lys et al.
2005/0151663 A1 7/2005 Tanguay
2005/0154494 A1 7/2005 Ahmed
2005/0174473 A1 8/2005 Morgan et al.
2005/0174780 A1 8/2005 Park
2005/0184667 A1 8/2005 Sturman et al.
2005/0201112 A1 9/2005 Machi et al.
2005/0206529 A1 9/2005 St.-Germain
2005/0213320 A1 9/2005 Kazuhiro et al.
2005/0213352 A1 9/2005 Lys
2005/0213353 A1 9/2005 Lys
2005/0218838 A1 10/2005 Lys
2005/0218870 A1 10/2005 Lys
2005/0219860 A1 10/2005 Schexnaider
2005/0219872 A1 10/2005 Lys
2005/0225979 A1 10/2005 Robertson et al.
2005/0231133 A1 10/2005 Lys
2005/0236029 A1 10/2005 Dowling
2005/0236998 A1 10/2005 Mueller et al.
2005/0248299 A1 11/2005 Chemel et al.
2005/0253533 A1 11/2005 Lys et al.
2005/0259424 A1 11/2005 Zampini, II et al.
2005/0265019 A1 12/2005 Sommers et al.
2005/0275626 A1 12/2005 Mueller et al.
2005/0276051 A1 12/2005 Caudle et al.
2005/0276053 A1 12/2005 Nortrup et al.
2005/0276064 A1 12/2005 Wu et al.
2005/0285547 A1 12/2005 Piepgras et al.
2006/0002110 A1 1/2006 Dowling et al.

2006/0012987 A9 1/2006 Ducharme et al.
2006/0012997 A1 1/2006 Catalano et al.
2006/0016960 A1 1/2006 Morgan et al.
2006/0022214 A1 2/2006 Morgan et al.
2006/0028155 A1 2/2006 Young
2006/0028837 A1 2/2006 Mrakovich
2006/0034078 A1 2/2006 Kovacik et al.
2006/0050509 A9 3/2006 Dowling et al.
2006/0050514 A1 3/2006 Opolka
2006/0071614 A1 4/2006 Tripathi et al.
2006/0076908 A1 4/2006 Morgan et al.
2006/0092640 A1 5/2006 Li
2006/0098077 A1 5/2006 Dowling
2006/0104058 A1 5/2006 Chemel et al.
2006/0109648 A1 5/2006 Trenchard et al.
2006/0109649 A1 5/2006 Ducharme et al.
2006/0109661 A1 5/2006 Coushaine et al.
2006/0126325 A1 6/2006 Lefebvre et al.
2006/0126338 A1 6/2006 Mighetto
2006/0132061 A1 6/2006 McCormick et al.
2006/0132323 A1 6/2006 Grady, Jr.
2006/0146531 A1 7/2006 Reo et al.
2006/0152172 A9 7/2006 Mueller et al.
2006/0158881 A1 7/2006 Dowling
2006/0170376 A1 8/2006 Piepgras et al.
2006/0192502 A1 8/2006 Brown et al.
2006/0193131 A1 8/2006 McGrath et al.
2006/0197661 A1 9/2006 Tracy et al.
2006/0198128 A1 9/2006 Piepgras et al.
2006/0208667 A1 9/2006 Lys et al.
2006/0221606 A1 10/2006 Dowling
2006/0221619 A1 10/2006 Nishigaki
2006/0232974 A1 10/2006 Lee et al.
2006/0262516 A9 11/2006 Dowling et al.
2006/0262521 A1 11/2006 Piepgras et al.
2006/0262544 A1 11/2006 Piepgras et al.
2006/0262545 A1 11/2006 Piepgras et al.
2006/0273741 A1 12/2006 Stalker, III
2006/0274529 A1 12/2006 Cao
2006/0285325 A1 12/2006 Ducharme et al.
2007/0035255 A1 2/2007 Shuster et al.
2007/0040516 A1 2/2007 Chen
2007/0041220 A1 2/2007 Lynch
2007/0047227 A1 3/2007 Ducharme
2007/0053182 A1 3/2007 Robertson
2007/0053208 A1 3/2007 Justel et al.
2007/0064419 A1 3/2007 Gandhi
2007/0070621 A1 3/2007 Rivas et al.
2007/0070631 A1 3/2007 Huang et al.
2007/0081423 A1 4/2007 Chien
2007/0086754 A1 4/2007 Lys et al.
2007/0086912 A1 4/2007 Dowling et al.
2007/0097678 A1 5/2007 Yang
2007/0109763 A1 5/2007 Wolf et al.
2007/0115658 A1 5/2007 Mueller et al.
2007/0115665 A1 5/2007 Mueller et al.
2007/0120594 A1 5/2007 Balakrishnan et al.
2007/0127234 A1 6/2007 Jervey, III
2007/0133202 A1 6/2007 Huang et al.
2007/0139938 A1 6/2007 Petroski et al.
2007/0145915 A1 6/2007 Roberge et al.
2007/0147046 A1 6/2007 Arik et al.
2007/0152797 A1 7/2007 Chemel et al.
2007/0153514 A1 7/2007 Dowling et al.
2007/0159828 A1 7/2007 Wang
2007/0165402 A1 7/2007 Weaver, Jr. et al.
2007/0173978 A1 7/2007 Fein et al.
2007/0177382 A1 8/2007 Pritchard et al.
2007/0182387 A1 8/2007 Weirich
2007/0188114 A1 8/2007 Lys et al.
2007/0188427 A1 8/2007 Lys et al.
2007/0189026 A1 8/2007 Chemel et al.
2007/0195526 A1 8/2007 Dowling et al.
2007/0195527 A1 8/2007 Russell
2007/0195532 A1 8/2007 Reisenauer et al.
2007/0205712 A1 9/2007 Radkov et al.
2007/0206375 A1 9/2007 Piepgras et al.
2007/0211463 A1 9/2007 Chevalier et al.
2007/0228999 A1 10/2007 Kit
2007/0235751 A1 10/2007 Radkov et al.
2007/0236156 A1 10/2007 Lys et al.
2007/0237284 A1 10/2007 Lys et al.
2007/0240346 A1 10/2007 Li et al.
2007/0241657 A1 10/2007 Radkov et al.
2007/0242466 A1 10/2007 Wu et al.
2007/0247842 A1 10/2007 Zampini et al.
2007/0247847 A1 10/2007 Villard
2007/0247851 A1 10/2007 Villard
2007/0258231 A1 11/2007 Koerner et al.
2007/0258240 A1 11/2007 Ducharme et al.
2007/0263379 A1 11/2007 Dowling
2007/0274070 A1 11/2007 Wedell
2007/0281520 A1 12/2007 Insalaco et al.
2007/0285926 A1 12/2007 Maxik
2007/0285933 A1 12/2007 Southard et al.
2007/0290625 A1 12/2007 He et al.
2007/0291483 A1 12/2007 Lys
2007/0296350 A1 12/2007 Maxik et al.
2008/0003664 A1 1/2008 Tysoe et al.
2008/0007945 A1 1/2008 Kelly et al.
2008/0012502 A1 1/2008 Lys
2008/0012506 A1 1/2008 Mueller et al.
2008/0013316 A1 1/2008 Chiang
2008/0013324 A1 1/2008 Yu
2008/0018261 A1 1/2008 Kastner
2008/0037245 A1 2/2008 Chan
2008/0037284 A1 2/2008 Rudisill
2008/0062680 A1 3/2008 Timmermans et al.
2008/0089075 A1 4/2008 Hsu
2008/0092800 A1 4/2008 Smith et al.
2008/0093615 A1 4/2008 Lin et al.
2008/0093998 A1 4/2008 Dennery et al.
2008/0094837 A1 4/2008 Dobbins et al.
2008/0130267 A1 6/2008 Dowling et al.
2008/0151535 A1 6/2008 de Castris
2008/0158871 A1 7/2008 McAvoy et al.
2008/0158887 A1 7/2008 Zhu et al.
2008/0164826 A1 7/2008 Lys
2008/0164827 A1 7/2008 Lys
2008/0164854 A1 7/2008 Lys
2008/0175003 A1 7/2008 Tsou et al.
2008/0180036 A1 7/2008 Garrity et al.
2008/0186704 A1 8/2008 Chou et al.
2008/0192436 A1 8/2008 Peng et al.
2008/0211419 A1 9/2008 Garrity
2008/0224629 A1 9/2008 Melanson
2008/0224636 A1 9/2008 Melanson
2008/0253125 A1 10/2008 Kang et al.
2008/0258647 A1 10/2008 Scianna
2008/0278092 A1 11/2008 Lys et al.
2008/0285257 A1 11/2008 King
2008/0285266 A1 11/2008 Thomas
2008/0290814 A1 11/2008 Leong et al.
2008/0291675 A1 11/2008 Lin et al.
2008/0315784 A1 12/2008 Tseng
2009/0002995 A1 1/2009 Lee et al.
2009/0016063 A1 1/2009 Hu
2009/0046473 A1 2/2009 Tsai et al.
2009/0052186 A1 2/2009 Xue
2009/0067182 A1 3/2009 Hsu et al.
2009/0086492 A1 4/2009 Meyer
2009/0091938 A1 4/2009 Jacobson et al.
2009/0140285 A1 6/2009 Lin et al.
2009/0175041 A1 7/2009 Yuen et al.
2009/0185373 A1 7/2009 Grajcar
2009/0195186 A1 8/2009 Guest et al.
2009/0196034 A1 8/2009 Gherardini et al.
2009/0213588 A1 8/2009 Manes
2009/0273926 A1 11/2009 Deng
2009/0303720 A1 12/2009 Mcgrath
2009/0316408 A1 12/2009 Villard
2010/0008085 A1 1/2010 Ivey et al.
2010/0019689 A1 1/2010 Shan
2010/0027259 A1 2/2010 Simon et al.
2010/0033095 A1 2/2010 Sadwick
2010/0033964 A1 2/2010 Choi et al.
2010/0096998 A1 4/2010 Beers

| | | | |
|---|---|---|---|
| 2010/0103664 | A1 | 4/2010 | Simon et al. |
| 2010/0109558 | A1 | 5/2010 | Chew |
| 2010/0265732 | A1 | 10/2010 | Liu |

FOREIGN PATENT DOCUMENTS

| | | | |
|---|---|---|---|
| CN | 2869556 | Y | 2/2007 |
| EP | 0013782 | B1 | 3/1983 |
| EP | 0091172 | A2 | 10/1983 |
| EP | 0124924 | B1 | 9/1987 |
| EP | 0174699 | B1 | 11/1988 |
| EP | 0197602 | B1 | 11/1990 |
| EP | 0214701 | B1 | 3/1992 |
| EP | 0262713 | B1 | 6/1992 |
| EP | 0203668 | B1 | 2/1993 |
| EP | 0272749 | B1 | 8/1993 |
| EP | 0337567 | B1 | 11/1993 |
| EP | 0390262 | B1 | 12/1993 |
| EP | 0359329 | B1 | 3/1994 |
| EP | 0403011 | B1 | 4/1994 |
| EP | 0632511 | A2 | 1/1995 |
| EP | 0432848 | B1 | 4/1995 |
| EP | 0403001 | B1 | 8/1995 |
| EP | 0525876 | B1 | 5/1996 |
| EP | 0714556 | B1 | 1/1999 |
| EP | 0458408 | B1 | 9/1999 |
| EP | 0578302 | B1 | 9/1999 |
| EP | 0723701 | B1 | 1/2000 |
| EP | 0787419 | B1 | 5/2001 |
| EP | 1195740 | A2 | 4/2002 |
| EP | 1016062 | B1 | 8/2002 |
| EP | 1195740 | A3 | 1/2003 |
| EP | 1149510 | B1 | 2/2003 |
| EP | 1056993 | B1 | 3/2003 |
| EP | 0766436 | B1 | 5/2003 |
| EP | 0924281 | B1 | 5/2003 |
| EP | 0826167 | B1 | 6/2003 |
| EP | 1147686 | B1 | 1/2004 |
| EP | 1142452 | B1 | 3/2004 |
| EP | 1145602 | B1 | 3/2004 |
| EP | 1422975 | A1 | 5/2004 |
| EP | 0890059 | B1 | 6/2004 |
| EP | 1348319 | B1 | 6/2005 |
| EP | 1037862 | B1 | 7/2005 |
| EP | 1346609 | B1 | 8/2005 |
| EP | 1321012 | B1 | 12/2005 |
| EP | 1610593 | A2 | 12/2005 |
| EP | 1624728 | A1 | 2/2006 |
| EP | 1415517 | B1 | 5/2006 |
| EP | 1415518 | B1 | 5/2006 |
| EP | 1438877 | B1 | 5/2006 |
| EP | 1166604 | B1 | 6/2006 |
| EP | 1479270 | B1 | 7/2006 |
| EP | 1348318 | B1 | 8/2006 |
| EP | 1399694 | B1 | 8/2006 |
| EP | 1461980 | B1 | 10/2006 |
| EP | 1110120 | B1 | 4/2007 |
| EP | 1440604 | B1 | 4/2007 |
| EP | 1047903 | B1 | 6/2007 |
| EP | 1500307 | B1 | 6/2007 |
| EP | 0922305 | B1 | 8/2007 |
| EP | 0922306 | B1 | 8/2007 |
| EP | 1194918 | B1 | 8/2007 |
| EP | 1048085 | B1 | 11/2007 |
| EP | 1763650 | B1 | 12/2007 |
| EP | 1776722 | B1 | 1/2008 |
| EP | 1459599 | B1 | 2/2008 |
| EP | 1887836 | A2 | 2/2008 |
| EP | 1579733 | B1 | 4/2008 |
| EP | 1145282 | B1 | 7/2008 |
| EP | 1157428 | B1 | 9/2008 |
| EP | 1000522 | B1 | 12/2008 |
| EP | 1502483 | B1 | 12/2008 |
| EP | 1576858 | B1 | 12/2008 |
| EP | 1646092 | B1 | 1/2009 |
| EP | 1579736 | B1 | 2/2009 |
| EP | 1889519 | B1 | 3/2009 |
| EP | 1537354 | B1 | 4/2009 |
| EP | 1518445 | B1 | 5/2009 |
| EP | 1624728 | B1 | 5/2009 |
| EP | 1337784 | B1 | 6/2009 |
| EP | 2013530 | B1 | 8/2009 |
| EP | 1461982 | B1 | 9/2009 |
| GB | 2215024 | A | 9/1989 |
| GB | 2324901 | A | 11/1998 |
| JP | 6-54103 | U | 7/1994 |
| JP | H6-54103 | | 7/1994 |
| JP | 7-249467 | | 9/1995 |
| JP | 08-162677 | | 6/1996 |
| JP | 11-135274 | A | 5/1999 |
| JP | 2001-238272 | A | 8/2001 |
| JP | 2002-141555 | A | 5/2002 |
| JP | 3098271 | U | 2/2004 |
| JP | 2004-335426 | | 11/2004 |
| JP | 2005-158363 | A | 6/2005 |
| JP | 2005-166617 | A | 6/2005 |
| JP | 2005-347214 | A | 12/2005 |
| JP | 2006-507641 | A | 3/2006 |
| JP | 3139714 | U | 2/2008 |
| JP | 2008-258124 | A | 10/2008 |
| KR | 10-2004-0008244 | A | 1/2004 |
| KR | 20-0430022 | Y1 | 11/2006 |
| KR | 10-0781652 | B1 | 12/2007 |
| KR | 10-0888669 | B1 | 3/2009 |
| TW | M337036 | | 7/2008 |
| WO | 9906759 | A1 | 2/1999 |
| WO | 99/10867 | A1 | 3/1999 |
| WO | 99/31560 | A2 | 6/1999 |
| WO | 9945312 | A1 | 9/1999 |
| WO | 00/01067 | A2 | 1/2000 |
| WO | 02/25842 | A2 | 3/2002 |
| WO | 02/061330 | A2 | 8/2002 |
| WO | 02/069306 | A2 | 9/2002 |
| WO | 02/091805 | A2 | 11/2002 |
| WO | 02/098182 | A2 | 12/2002 |
| WO | 02/099780 | A2 | 12/2002 |
| WO | 03/026358 | A1 | 3/2003 |
| WO | 03/055273 | A2 | 7/2003 |
| WO | 03/067934 | A2 | 8/2003 |
| WO | 03/090890 | A1 | 11/2003 |
| WO | 03/096761 | A1 | 11/2003 |
| WO | 2004/021747 | A2 | 3/2004 |
| WO | 2004/023850 | A2 | 3/2004 |
| WO | 2004/032572 | A2 | 4/2004 |
| WO | 2004057924 | A1 | 7/2004 |
| WO | 2004/100624 | A2 | 11/2004 |
| WO | 2005031860 | A2 | 4/2005 |
| WO | 2005/052751 | A2 | 6/2005 |
| WO | 2005/060309 | A2 | 6/2005 |
| WO | 2005/084339 | A2 | 9/2005 |
| WO | 2005/089293 | A2 | 9/2005 |
| WO | 2005/089309 | A2 | 9/2005 |
| WO | 2006/023149 | A2 | 3/2006 |
| WO | 2006044328 | A1 | 4/2006 |
| WO | 2006/093889 | A2 | 9/2006 |
| WO | 2006/127666 | A2 | 11/2006 |
| WO | 2006/127785 | A2 | 11/2006 |
| WO | 2006/133272 | A2 | 12/2006 |
| WO | 2006137686 | A1 | 12/2006 |
| WO | 2007/081674 | A1 | 7/2007 |
| WO | 2007/094810 | A2 | 8/2007 |
| WO | 2007090292 | A1 | 8/2007 |
| WO | 2008137460 | A2 | 11/2008 |
| WO | 9957945 | A1 | 9/2009 |
| WO | 2010/030509 | A2 | 3/2010 |

OTHER PUBLICATIONS

Wolsey, Robert. Interoperable Systems: The Future of Lighting Control, Lighting Research Center, Jan. 1, 1997, vol. 2 No. 2, Rensselaer Polytechnic Institute, Troy, New York [online]. Retrieved Lighting Research Center Web Page using Internet <URL: http://www.lrc.rpi.edu/programs/Futures/LF-BAS/index.asp>.

Experiment Electronic Ballast. Electronic Ballast for Fluorescent Lamps [online], Revised Fall of 2007. [Retrieved on Sep. 1, 1997]. Retrieved from Virginia Tech Web Page using Internet <URL: http://www.ece.vt.edu/ece3354/labs/ballast.pdf.>.

Truck-Lite, LEDSelect—LED, Model 35, Clearance & Marker Lighting, [online], [retrieved on Jan. 13, 2000] Retrieved from Truck-Lite Web Page using Internet <URL: http://trucklite.com/leds14.html>.
Truck-Lite, LEDSelect—LED, Super 44, Stop, Turn & Tail Lighting, [online], [retrieved on Jan. 13, 2000] Retrieved from Truck-Lite Web Page using Internet <URL: http://trucklite.com/leds2.html>.
Truck-Lite, LEDSelect—LED, Model 45, Stop, Turn & Tail Lighting [online], [retrieved on Jan. 13, 2000] Retrieved from Truck-Lite Web Page using Internet <URL: http://trucklite.com/leds4.html>.
Telecite Products & Services—Display Options, [online], [retrieved on Jan. 13, 2000] Retrieved from Telecite Web page using Internet <URL: http://www.telecite.com/en/products/options en.htm>.
Traffic Signal Products—Transportation Products Group, [online], [retrieved on Jan. 13, 2000] Retrieved from the Dialight Web Page using Internet <URL: http://www.dialight.com/trans.htm>.
LED Lights, Replacement LED lamps for any incandescent light, [online], [retrieved on Jan. 13, 2000] Retrieved from LED Lights Web Page using Internet <URL: http://www.ledlights.com/replac.htm>.
Ledtronics, Ledtronics Catalog, 1996, p. 10, Ledtronics, Torrance, California.
Piper. The Best Path to Efficiency. Building Operating Management, Trade Press Publishing Company May 2000 [online], [retrieved on Jan. 17, 2008]. Retrieved from Find Articles Web Page using Internet <URL:http://findarticles.com/p/articles/mi_qu3922/is_200005/ai_n8899499/>.
Henson, Keith. The Benefits of Building Systems Integration, Access Control & Security Systems Integration, Oct. 1, 2000, Penton Media. [online], [retrieved on Oct. 24, 2008] Retrieved from Security Solutions Web page using Internet <URL: http://securitysolutions.com/mag/security_benefits_building_systems/>.
Phason Electronic Control Systems, Light Level Controller (LLC) case study. Nov. 30, 2004. 3 pages, Phason Inc., Winnipeg, Manitoba, Canada.
Airport International. Fly High With Intelligent Airport Building and Security Solutions [online], [retrieved on Oct. 24, 2008]. Retrieved from Airport International web page using Internet <URL: http://www.airport-int.com/categories/airport-building-and-security-solutions/fly-high-with-intelligent-airport-building-and-security-solutions.html>.
D.N.A.-III, [online], [retrieved Mar. 10, 2009] Retrieved from the PLC Lighting Web Page using Internet <URL: http://www.plclighting.com/product_info.php?cPath=1&products_id=92>.
E20116-18 Larmes Collection, [online], [retrieved on Jul. 10, 2010] Retrieved from ET2 Contemporary Lighting using Internet <URL: http://www.et2online.com/proddetail.aspx?ItemID=E20116-18>.
E20112-22 Starburst Collection, [online], [retrieved on Jul. 10, 2010] Retrieved from ET2 Contemporary Lighting using Internet <URL: http://www.et2online.com/proddetail.aspx?ItemID=E20112-22>.
E20524-10 & E20525-10 Curva Collection, [online], [retrieved on Jul. 10, 2010] Retrieved from ET2 Contemporary Lighting using Internet <URL: http://www.et2online.com/proddetail.aspx?ItemID=E20524-10 & E20525-10>.
E22201-44 Esprit Collection, [online], [retrieved on Jul. 10, 2010] Retrieved from ET2 Contemporary Lighting using Internet <URL: http://www.et2online.com/proddetail.aspx?ItemID=E22201-44>.
E20743-09 Stealth Collection, [online], [retrieved on Jul. 10, 2010] Retrieved from ET2 Contemporary Lighting using Internet <URL: http://www.et2online.com/proddetail.aspx?ItemID=E20743-09>.
Spencer, Eugene. High Sales, Low Utilization. Green Intelligent Buildings, Feb. 1, 2007. [online]. Retrieved from Green Intelligent Buildings web page using Internet <URL: http://www.greenintelligentbuildings.com/CDA/IBT_Archive/BNP_GUID_9-5-2006_A_1000000000000056772>.
Sensor Switch, nLight Lighting Control System, [online], [retrieved on Jan. 11, 2008] Retrieved from Sensor Switch web page using Internet <URL: http://www.sensorswitch.com>.
Six Strategies, [online], [retrieved on Jan. 11, 2008] Retrieved from Encelium Technologies Inc. Web Page using Internet <URL: http://www.encelium.com/products/strategies.html>.
Lawrence Berkeley National Labratory. Lighting Control System—Phase Cut Carrier. University of California, [online] [retrieved on Jan. 14, 2008] Retrieved from Lawrence Berkeley National Labratory web page using Internet <URL: http://www.lbl.gov/tt/techs/lbnl1871.html>.
Best Practice Guide—Commercial Office Buildings—Central HVAC System. [online], [Retrieved on Jan. 17, 2008] Retrieved from Flex Your Power Organization web page using Internet <URL: http://www.fypower.org/bpg/module.html?b=offices&m+Central HVAC Systems&s=Contr . . . >.
Cornell University. Light Canopy—Cornell University Solar Decathlon, [online], [retrieved on Jan. 17, 2008] Retrieved from Cornell University web page using Internet <URL: http://cusd.cornell.edu/cusd/web/index.php/page/show/section/Design/page/controls>.
PLC-96973-PC PLC Lighting Elegance Modern/Contemporary Pendant Light, [online], [retrieved on Feb. 27, 2009] Retrieved from the Arcadian Lighting Web Page using Internet <URL: http//www.arcadianlighting.com/plc-96978-pc.html>.
PLC-81756-AL "Fireball" Contemporary Pendant Light, [online], [retrieved on Feb. 27, 2009] Retrieved from the Arcadian Lighting Web Page using Internet <URL: http//www.arcadianlighting.com/plc-81756-al.html>.
Philips. Sense and Simplicity—Licensing program for LED Luminaires and Retrofits, Philips Intellectual Property & Standards. May 5, 2009.

* cited by examiner

ILLUMINATION DEVICE INCLUDING LEDS AND A SWITCHING POWER CONTROL SYSTEM

CROSS-REFERENCE TO RELATED APPLICATIONS

This application claims priority to Provisional Application Ser. No. 61/219,627, filed Jun. 23, 2009, which is hereby incorporated by reference in its entirety.

TECHNICAL FIELD

The present invention relates in general to conversion of an alternating current (AC) to direct current (DC), and more specifically, to an illumination device including light-emitting diodes and a switching power control system.

BACKGROUND

Incandescent light bulbs are gradually being replaced by light-emitting diodes (LEDs) in many applications. LEDs have many advantages over traditional incandescent lamps in that they have longer operational life, reduced power consumption, greater durability and increased design flexibility.

Despite these advantages, at present LEDs are not used in all applications. LEDs commonly operate on a supply of DC. Accordingly, many applications that use LEDs require conversion of an AC power supply to a DC power supply. For example, U.S. Pat. No. 7,049,761 assigned to the assignee of this invention, discloses a power supply circuit that includes a rectifier circuit and a PWM switching circuit. The rectifier converts AC power to DC power and the PWM switching circuit receives the DC power and pulse-width modulates the DC power to supply an LED array. Known converters are not practical for use with some LED applications because of their size and excessive cost. Passive components such as capacitors and inductors within known converters become larger as operating voltages increase thereby increasing the overall size and cost of the LED device.

SUMMARY

Embodiments of an illumination device are disclosed herein. The illumination device includes light-emitting diodes, an alternating current input, a full-wave rectifier coupled to the alternating current input and configured to produce a rectified voltage output and a power converter. The power converter has a switching element electrically coupled to the rectified voltage output of the full-wave rectifier. In one embodiment, an improvement of the illumination device includes a feedback circuit configured to determine an average current across the light-emitting diodes and to invert a signal representing the average current to provide a switching signal to the switching element such that, for a range of operating points, increasing a current drawn into the power converter will decrease LED power and decreasing the current drawn into the power converter will increase LED power.

Embodiments of an illumination device having at least one LED and a power converter with a switching element for connection to an existing fluorescent lamp fixture including a conventional ballast are also disclosed herein. In one embodiment, an improvement to the illumination device includes a feedback circuit operable to provide a switching signal to the switching element according to a duty cycle. The feedback circuit is configured to increase the value of the duty cycle to decrease an output current signal through the LEDs and to decrease the value of the duty cycle to increase the output current signal through the LEDs.

Embodiments of a method of controlling a feedback circuit for an illumination device having at least one LED and a power converter with a switching element are also disclosed herein. In one embodiment, the method includes determining an average current across the at least one LED and inverting a signal representing the average current such that, for a range of operating points, increasing a current drawn into the power converter will decrease LED power and decreasing the current drawn into the power converter will increase LED power. The method also includes providing the switching signal to the switching element.

These and other embodiments are described in additional detail hereinafter.

BRIEF DESCRIPTION OF THE DRAWING

The various features, advantages and other uses of the present invention will become more apparent by referring to the following detailed description and drawing in which.

DETAILED DESCRIPTION

Embodiments of the invention power a LED lighting fixture through an existing ballast designed to power a fluorescent bulb using a novel circuit topology and control system requiring only a single active switch. Power dissipation and component count are minimized, and advanced controls, such as dimming, are possible. Such embodiments are best explained by reference to FIGS. 1A-13.

To control power in a set of light-emitting diodes (LEDs), as described herein it is desirable to control the total current through them. Since the voltage $V_{led}$ across the LEDs is substantially constant when the LEDs are on, a desired power level P supplied to the LEDs conforms to the following equation:

$$P_{led}=V_{led}*I_{led}; \text{ wherein} \quad (1)$$

$I_{led}$ is the total current through the LEDs.

Figure 1A:
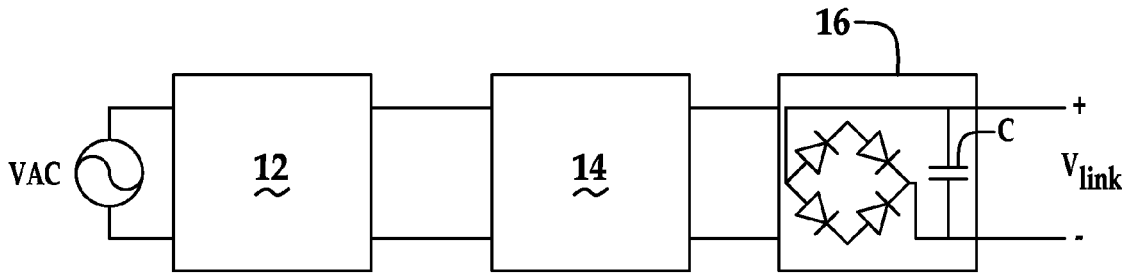
FIG. 1A is a block diagram of a power supply provided by a basic ballast with a rectifier circuit.
Figure 1B:
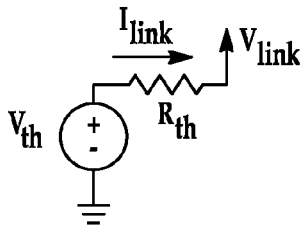
FIG. 1B is a Thevenin equivalent circuit of FIG. 1A.

As shown in FIG. 1A, a power supply includes a ballast 12 receiving an AC input 10 from a conventional source such as a 110 VAC outlet. Ballast 12 is a conventional ballast that supplies a fluorescent bulb. The output of ballast 12 is generally a higher voltage AC source, which is rectified to a DC link voltage by a full-wave rectifier 16, shown in the form of a diode bridge by example. Between ballast 12 and rectifier 16 is protection 14 in the form of, for example, diodes, etc., to protect components of rectifier 16 and the LEDs of the load from voltage spikes.

As a steady-state approximation, fluorescent ballast 12 and rectifier 16 act as a Thevenin equivalent power source as shown in FIG. 1A and as described in the following equation:

$$V_{link}=V_{th}-I_{link}*R_{th}; \text{ wherein} \quad (2)$$

$V_{link}$ is the rectified DC link voltage;

$V_{th}$ is the Thevenin equivalent voltage for ballast 12 and rectifier 16;

$I_{link}$ is the current drawn from the DC supply; and $R_{th}$ is the Thevenin equivalent resistance for ballast 12 and rectifier 16. The Thevenin equivalent values $V_{th}$ and $R_{th}$ are modeled as constant for any given ballast. Such values can be obtained through, for example, testing.

As seen from equation (2), the DC link voltage $V_{link}$ decreases in a linear fashion as $I_{link}$ increases.

Figure 2:
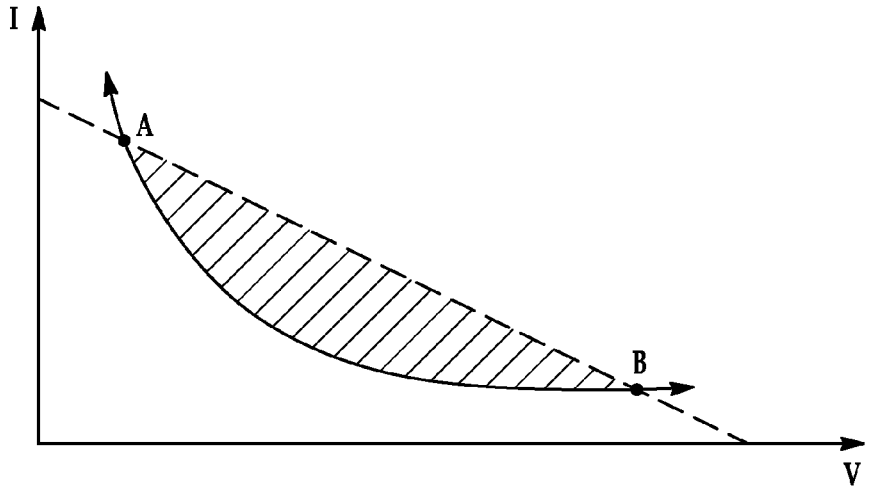
FIG. 2 is a load-line plot of FIG. 1A.

This can be seen graphically in FIG. 2, where it is assumed that the DC output of the Thevenin equivalent circuit is used to directly drive the LEDs. More specifically, the graph of FIG. 2 plots both equation (1) and equation (2) in terms of current (I) versus voltage (V). The load curve, that is, that corresponding to equation (1), is shown as a solid line. Conversely, the source curve, which corresponds to equation (2), is shown as a dashed line.

There are two points where the load and source curves crossover, point A and point B. Point A corresponds to a low-voltage, high-current supply, while point B corresponds to a high-voltage, low-current supply. The shaded area between the curves and points A and B represents ballast current exceeding the need of the LEDs, that is, where power supplied by the link $P_{link}$ (which is equal to $V_{link}*I_{link}$) is greater than $P_{led}$. Point A is conventionally considered an unstable operating point because increasing current to a power converter decreases the power draw to the LEDs. Point B is conventionally considered a stable operating point because increasing current to the power converter increases the power draw to the LEDs.

Even though point A is an unstable operating point, it desirable to operate at this point as described herein because, among other advantages, smaller and less expensive components can be used for control of the DC output.

Figure 3:
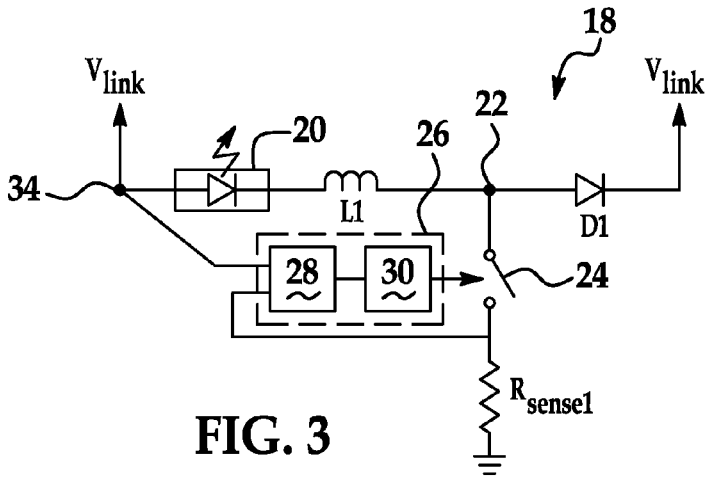
FIG. 3 is one embodiment of a circuit topology and feedback control system taught herein.

FIG. 3 illustrates the topology of one circuit 18 that can operate at this low-voltage, high-current operating point in a stable manner. The embodiment includes a low-side switch 24. More specifically, circuit 18 applies the DC link voltage $V_{link}$ across at least one LED, represented by LED 20, connected in series with an inductor L1 and a diode D1. While LED 20 is described as connected in series with the inductor L1 and diode D1, the LEDs that comprise LED 20 are not necessarily themselves connected in series to one another. That is, LED 20 can represent a plurality of LEDs connected in parallel and/or in series with respect to each other. LED 20 could, for example, be in the form of an array. LED 20 can include surface-mounted or discrete LED components. In certain embodiments, it would be desirable if LED 20 were one or more organic LEDs. Although not specifically shown, relatively small resistors can be inserted between the LEDs in order to provide the correct current draw in the passive circuit design.

Inductor L1 provides discharging and charging current that, together with a capacitor C of DC rectifier 16, smooth the DC link voltage $V_{link}$. Diode D1 can prevent reverse currents from flowing through the circuit.

Connected from a tap 22 between inductor L1 and diode D1 to ground is low-side switch 24 and a sense resistor $R_{sense1}$. When switch 24 is closed, the current flowing across sense resistor $R_{sense1}$ is monitored. The current so measured is a peak current at the applied DC link voltage $V_{link}$. This peak current can be used to calculate (or estimate) the average current through LED 20. For example, the average current can be calculated from the peak current if the operating point and/or some component values of the circuitry are known. Alternatively or in addition to this technique, the average current through LED 20 can be measured via a high side sense resistor, voltage sensing, measuring the emitted light or other suitable technique.

The measured current is supplied to a feedback circuit 26 including a control system 28 for a pulse width modulator 30. Control system 28 also receives as input the DC link voltage $V_{link}$. In general, operation of feedback circuit 26 is based on assuming that increasing the duty cycle at switch 24 will decrease LED 20 power (or decrease current through LED 20) and that decreasing the duty cycle at switch 24 will increase LED 20 power (or increase current through LED 20) when the duty cycle exceeds a predetermined value. Basically, feedback circuit 26 adjusts the duty cycle based on, for example, the current through LED 20 and the voltage $V_{link}$. This logic can be used to (through feedback circuit 26) "invert" the sense of the feedback such that an increase in the current in LED 20 leads to an increase in the duty cycle and a decrease in the current in LED 20 leads to a decrease in the duty cycle.

Figure 4:
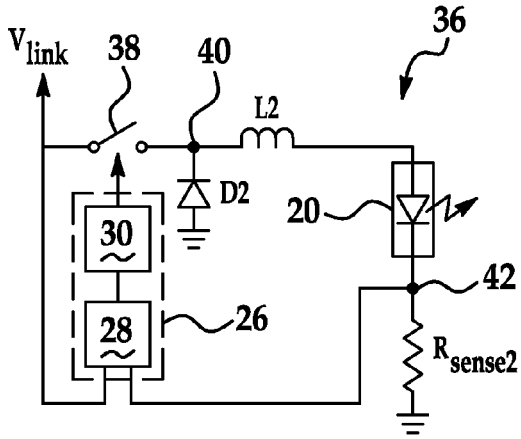
FIG. 4 is a second embodiment of the circuit topology and feedback control system taught herein.

FIG. 4 illustrates the topology of another circuit 36 that can stably operate at this low-voltage, high-current operating point. The embodiment includes a high-side switch 38 that selectively supplies the DC link voltage $V_{link}$ to LED 20 and inductor L2, which are connected in series to ground through sense resistor $R_{sense2}$. Diode D2 is connected to a tap 40 between high-side switch 38 and inductor L2 such that diode D2 is reverse-biased when high-side switch 38 is closed and is in parallel with LED 20.

Inductor L2 provides discharging and charging current that, together with capacitor C of DC rectifier 16, smooth the DC link voltage $V_{link}$. Diode D2 prevents reverse currents from flowing through the circuit.

The current across the sense resistor $R_{sense2}$ is read from a tap 42 between LED 20 and sense resistor $R_{sense2}$. Unlike circuit 18 of FIG. 3, current can be continuously monitored because the sensing in FIG. 4 is not tied to the ON-state of the switch 38. Accordingly, the average current through LED 20 is easily obtained in this embodiment.

The measured current is supplied to feedback circuit 26 described with reference to the first embodiment.

Figure 5:
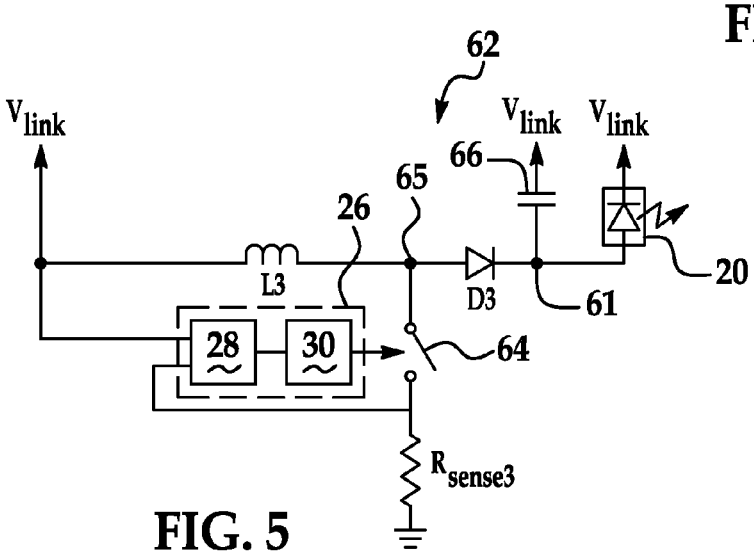
FIG. 5 is a third embodiment of the circuit topology and feedback control system taught herein.

FIG. 5 illustrates the topology of another circuit 62 that can stably operate at this low-voltage, high-current operating point. Similar to the embodiment of FIG. 2, this embodiment includes a low-side switch 64. More specifically, circuit 62 applies the DC link voltage $V_{link}$ through inductor L3. Connected from a tap 65 between inductor L3 and diode D3 to ground is low-side switch 64 and a sense resistor $R_{sense3}$. Diode D3 is connected between tap 65 and a tap 67. A capacitor 66 and LED 20 are connected in parallel and are connected between tap 67 and the DC link voltage $V_{link}$.

When the switch open, circuit 62 supplies current from the DC link voltage $V_{link}$ to inductor L3 via diode D3 and the capacitor 66 supplies current to the LED 20. When the switch is closed and when energy is stored into the inductor L3, the inductor L4 supplies current to LED 20.

When switch 64 is closed, the current flowing across sense resistor $R_{sense3}$ is monitored. Similar to the first embodiment, the average current can be calculated, for example from the peak current or by any other suitable technique. The measured current is supplied to feedback circuit 26 as is described with reference to the first embodiment.

Figure 6:
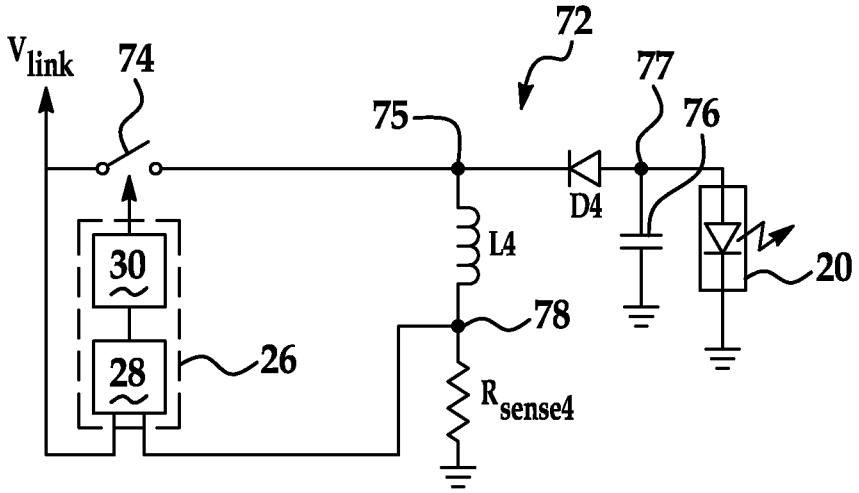
FIG. 6 is a fourth embodiment of the circuit topology and feedback control system taught herein.

FIG. 6 includes illustrates the topology of another circuit 72 that can stably operate at this low-voltage, high-current operating point. The embodiment includes a high-side switch 74 that selectively supplies the DC link voltage $V_{link}$ to LED 20 and inductor L4. Inductor L4 and a sense resistor $R_{sense4}$ are connected to ground from a tap 75 between high-side switch 74 and diode D4. Diode D4 is connected between tap 75 and a tap 77. A capacitor 76 is connected between tap 77 and ground and is in parallel with inductor L4 and $R_{sense4}$. LED 20 is also connected in parallel to capacitor 76 and is also in parallel with inductor L4 and $R_{sense4}$.

When the switch is in the ON-state, circuit 72 supplies current from the DC link voltage $V_{link}$ to inductor L4 and the capacitor 76 supplies current to the LED 20. When the switch is in the OFF-state and when energy is stored into the inductor L4, the inductor L4 supplies current to LED 20 via diode D4.

The current across the sense resistor $R_{sense4}$ is read from a tap 78 between inductor L4 and sense resistor $R_{sense4}$. Similar to the circuit of FIG. 4, current can be continuously monitored because the sensing in FIG. 6 is not tied to the ON-state of the switch 74. The measured current is supplied to feedback circuit 26 as is described with reference to the first embodiment.

Low-side switches 24 and 64 and high-side switches 38 and 74 can be any number of single switching elements. For example, a solid-state switch such as a field-effect transistor (FET), MOSFET, npn or pnp transistors, etc., can be used. Although only one switching element is shown, in each of FIGS. 3-6, each of the power converting circuits may have any suitable number of switches.

Further, the circuit topologies shown in FIGS. 3-6 are merely exemplary and other circuit structures having same or similar components may be utilized and implemented with a feedback circuit 26.

Assuming 100% efficient power conversion, the following relationships results:

$$P_{in}=P_{out}=V_{link}*I_{link}=V_{led}*I_{led}; \text{ wherein} \tag{3}$$

$P_{in}$ is the power of the input into the power converter; and $P_{out}$ is the output power of the LED 20 (or $P_{led}$).

Figure 7:
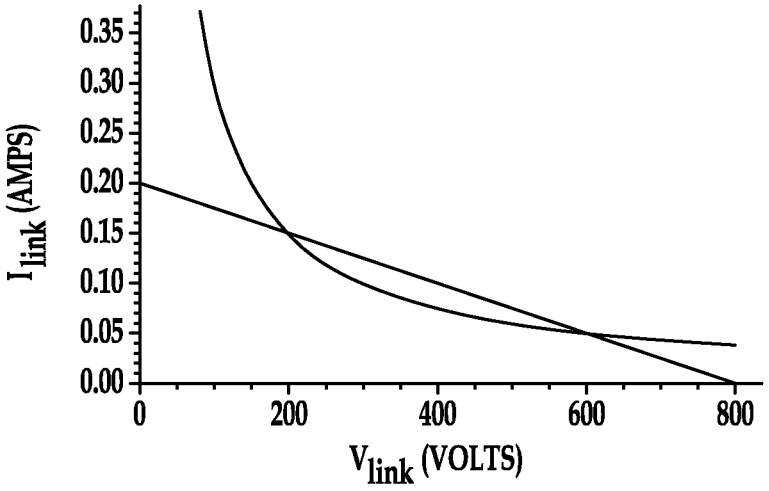
FIG. 7 is a load-line plot V/I using exemplary values for the ballast and load in a general case.
Figure 8:
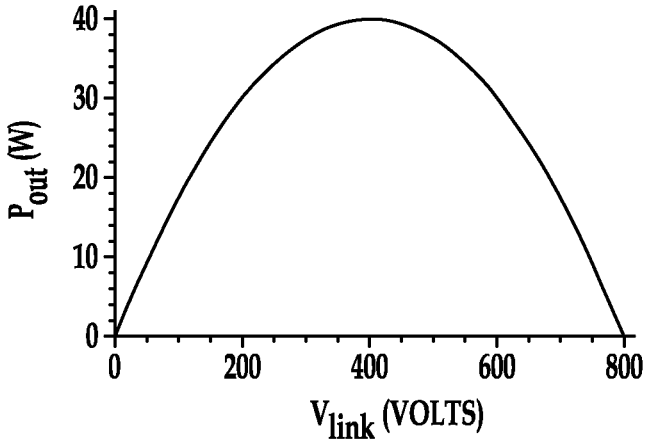
FIG. 8 is a plot of $P_{led}$ vs $V_{link}$ in the general case.

FIG. 7 is a load-line plot of $I_{link}$ vs. $V_{link}$. As can be seen, these curves follow the theoretical curves shown in FIG. 2. The plot of FIG. 8 illustrates the parabolic relationship of $P_{out}$ vs. $V_{link}$ for the general case of FIG. 7. Although not illustrated, a plot of $P_{led}$ vs. $I_{led}$ and a plot of $I_{led}$ vs $I_{link}$ have the same parabolic relationships as illustrated in FIG. 8.

Combining equation (3) with the Thevenin equivalent source model represented by equation (2) gives a relationship between $I_{led}$ and $I_{link}$:

$$I_{led} = \frac{V_{th}}{V_{led}} I_{link} - \frac{R_{th}}{V_{led}} I_{link}^2 \tag{4}$$

The relationship set forth in equation (4) is valid, for example, for power converters having 100% efficient power conversion driven by the Thevenin equivalent source and driving a constant voltage load.

Further, for each value of $I_{link}$, the equation gives a unique value of $I_{led}$.

The maximum value of $I_{led}$ can be found using equation (4) and can be represented as follows:

$$I_{link(Iledmax)} = \frac{V_{th}}{2R_{th}} \tag{5}$$

The maximum value of $I_{led}$ is also the maximum power transfer point.

The power converters described above with reference to FIGS. 3-6, or any other suitable power converter, can operate in either discontinuous or continuous mode. The mode (discontinuous or continuous) can be determined by the duty cycle D, the period T, and the circuit element values of the power converter. For example, one circuit element value that can control the mode is the value of the inductor L (e.g. L1, L2, L3 or L4 respectively of FIGS. 3-6) As will be discussed in more detail below, for instance, the inductor L can be chosen to achieve a transition from discontinuous mode to continuous mode at approximately $0.7<D<0.8$.

For the power converter illustrated in FIGS. 3 and 4, the current drawn from the power source in discontinuous mode can be represented by the following equation:

$$I_{linkdisc} = \frac{V_{th} - V_{led}}{\frac{2L}{D^2T} + R_{th}}; \text{ wherein} \tag{6}$$

$I_{linkdisc}$ is the current drawn from the power source in discontinuous mode; and L is the value of the inductor in the power converter in FIG. 3 or FIG. 4.

The current drawn from the power source in continuous mode can be represented by the following equation:

$$I_{linkcont} = \frac{V_{th}}{R_{th}} - \frac{V_{led}}{DR_{th}}; \text{ wherein} \tag{7}$$

$I_{linkdisc}$ is the current drawn from the power source in continuous mode.

Figure 9:
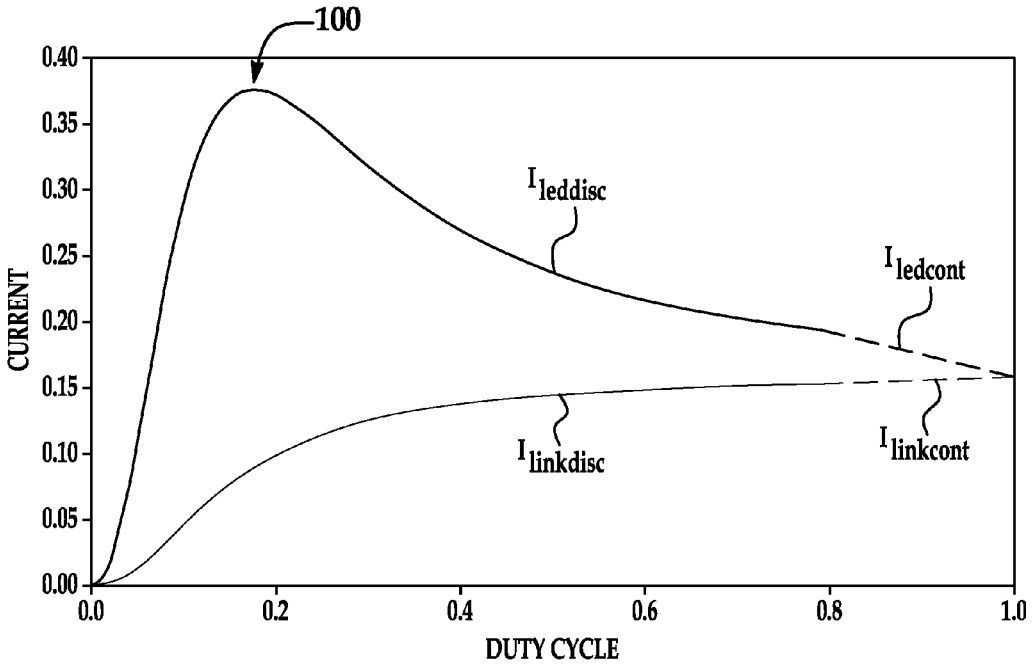
FIG. 9 is a plot of $I_{led}$ and $I_{link}$ vs. duty cycle when being driven by the circuit topology of FIG. 3 or 4.

As can be seen in FIG. 9, both equations (6) and (7) are monotonically increasing functions of D. Accordingly, the value of $I_{link}$ (or more specifically for each mode as shown in FIG. 9, $I_{linkdisc}$ or $I_{linkcont}$) can be controlled by controlling the value of the duty cycle D. Similarly, since $I_{led}$ (or more specifically for each mode as shown in FIG. 9, $I_{leddisc}$ or $I_{ledcont}$) $I_{led}$ can also be represented as a function of $I_{link}$ as set forth in equation (4), the value of $I_{led}$ can also be controlled by controlling the value of the duty cycle D.

From these equations, feedback circuit 26 can be configured such that the duty cycle D is greater than the duty cycle that results in the maximum value of as set forth in equation (5). The maximum value of $I_{led}$ is shown as point 100 in FIG. 9. After the peak at point 100, $I_{leddisc}$ and $I_{ledcont}$ (i.e. the average current through LED 20) will decrease as D increases.

Accordingly, feedback circuit 26 can be configured in FIG. 3 or 4 (or other power converter) to achieve the following:

1) a value of a duty cycle greater than the value needed to achieve the maximum value of $I_{led}$ (i.e. peak at point 100);

2) an increase in the duty cycle D decreases $I_{led}$ current; and 3) a decrease in the duty cycle D increases $I_{led}$ current.

As discussed previously and as shown in FIG. 9, the value of the inductor L can be chosen such that the transition from discontinuous mode to continuous mode is at approximately 0.7<D<0.8. Of course, other suitable points of transit are possible and can be based on factors in lieu of or in addition to the value of inductor L.

As discussed previously, this configuration is contrary to the ordinary function of known feedback circuits. In known feedback circuits, an increase in the duty cycle D can increase the current through the LED and a decrease in the duty cycle D can decrease the duty cycle D. Embodiments of the present invention can, at a minimum, invert this relationship.

Similar relationships as those discussed above also exist for the power converters illustrated in FIGS. 5 and 6. For example, analogous to equations (6) and (7), the $I_{link}$ current can be represented by the following relationships:

$$I_{linkdisc2} = \frac{V_{th}}{\frac{2L}{D^2T} + R_{th}} \tag{8}$$

$$I_{linkcont2} = \frac{V_{th} + V_{led}}{R_{th}} - \frac{V_{led}}{DR_{th}} \tag{9}$$

Figure 10:
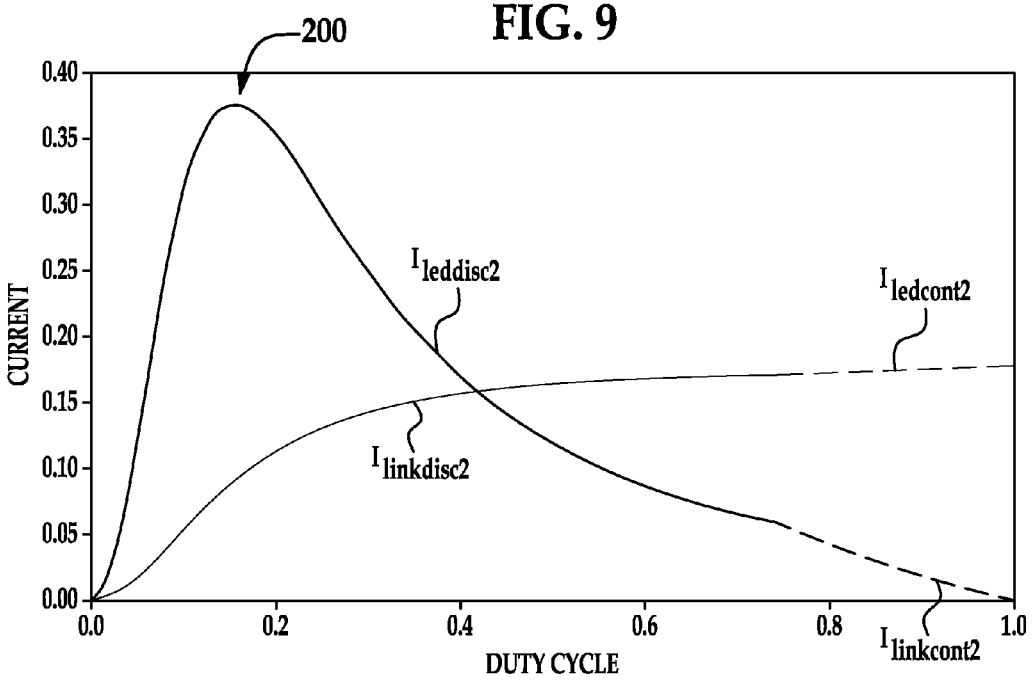
FIG. 10 is a plot of $I_{led}$ and $I_{link}$ vs. duty cycle when being driven by the circuit topology of FIG. 5 or 6.

As can be seen in FIG. 10 and similar to the $I_{link}$ equations discussed previously, both equations (8) and (9) are monotonically increasing functions of D. Accordingly, the values of $I_{linkdisc2}$ and $I_{linkcont2}$ an be controlled by controlling the value of the duty cycle D. Similarly, since $I_{led}$ (or more specifically for each mode as shown in FIG. 10, $I_{leddisc2}$ or $I_{ledcont2}$). As discussed previously, $I_{led}$ can be represented as a function of $I_{link}$ as set forth in equation (4) so that the value of $I_{led}$ can also be controlled by controlling the value of the duty cycle D. Accordingly, similar to that discussed above feedback circuit 26 can be configured in FIG. 5 or 6 (or other power converter) to achieve the following:

1) a value of a duty cycle greater than the value needed to achieve the maximum value of $I_{led}$ (i.e. peak at point 200);

2) an increase in the duty cycle D decreases $I_{led}$ current; and 3) a decrease in the duty cycle D increases $I_{led}$ current.

In addition, using the circuitry as taught herein, dimming of LED 20 can also be achieved by varying the duty cycle D.

Power converter or control circuits taught herein, such as circuits 18, 36, 62 or 72 can be used in conjunction with many applications to supply LED arrays. For example, circuits 18, 36, 62 or 72 can be used with LED arrays for communication with building controls and monitors. One use is to implement circuits 18, 36, 62 or 72 with powering, dimming and/or color control. Powering and/or dimming control can be accomplished by measuring a light level at the LED arrays or at a location remote from the LED arrays. Powering and/or dimming control can also be accomplished by using motion sensors in the LED arrays or at a location remote from the LED arrays. The motion sensors in the LED arrays may also include time delay logic. Color control can be accomplished through controlling LED array light color through ambient light sensors.

Circuits 18, 36, 62 or 72 can also be used with powering, dimming and/or color control that is controlled remotely or through the internet. Calendar-clock functions and LED array lighting circuitry can be used with circuits 18, 36, 62 or 72 so that individual and/or groups of lights can be programmed to power on or power off and dim at preset times.

Moreover, circuits 18, 36, 62 or 72 can be integrated with other applications to provide functions in addition to lighting of LED arrays. Some examples are (1) integrating circuits 18, 36, 62 or 72 with an HVAC control panel to allow one central control function to switch building functions into an "occupied" or "unoccupied" mode; (2) integrating circuits 18, 36, 62 or 72 with light controls to use in building alarms to improve burglar, smoke and fire alarm systems; (3) integrating circuits 18, 36, 62 or 72 with light controls and emergency power generators such that lights will detect when a building is on backup power and thus, switch into a reduced-power draw mode; (4) integrating circuits 18, 36, 62 or 72 with sound cards and small speakers in building lights, such that alarms, announcements; emergency broadcasts and background music can be wirelessly sent to sound-enabled lights, which can eliminate the need for separate building sound systems; (5) integrating circuits 18, 36, 62 or 72 with lights and emergency notifications, including telephone extensions, intrusion, robbery and fire alarms such that the lights in the notifying area flash in a distinctive pattern in order to guide emergency personnel to the event area. The notifying area may be at the same location as the event area or at a location separate from the event area.

Circuits 18, 36, 62 or 72 can also be used with controls that limit the amount of power used based on communication from a building's power supply monitoring, such that at times of peak building power use, the lights will automatically dim unless there is an authorized manual override. Moreover, circuits 18, 36, 62 or 72 can be used with LED arrays that self-diagnose and report lumen/wattage performance to a building controller/monitor so that the LEDs can be replaced when they become inefficient. Microphones can be integrated into the lighting circuitry for communication and remote sound monitoring functions. Likewise, still image and video cameras can be integrated into the lighting circuitry for security and remote area monitoring.

According to one example as described above, a dimming function can be provided by a number of configurations incorporating embodiments according to the invention. Currently, dimming is easy and inexpensive to accomplish in incandescent systems. Most commonly, it is implemented using phase control dimmers.

Because of the operating characteristics of most fluorescent ballasts, however, phase control dimmers work poorly or not at all. Dimming fluorescent lighting requires special ballasts, and in many cases requires special dimming controls and specialized building wiring. These systems are more expensive to install than non-dimmable systems because of increased ballast, dimmer and wiring costs. Because of this, most fluorescent installations are not dimmable.

Embodiments of the invention can add dimming functionality to a fluorescent lighting system when replacing the conventional fluorescent lamp with an LED-based replacement as previously described. These embodiments provide several advantages over current dimming technology, including a retrofit of dimmable LED lamps to non-dimmable fluorescent systems, no-tool installation of the hand-held remote implementation and dimmable operability with or without existing ballasts.

Figure 11:
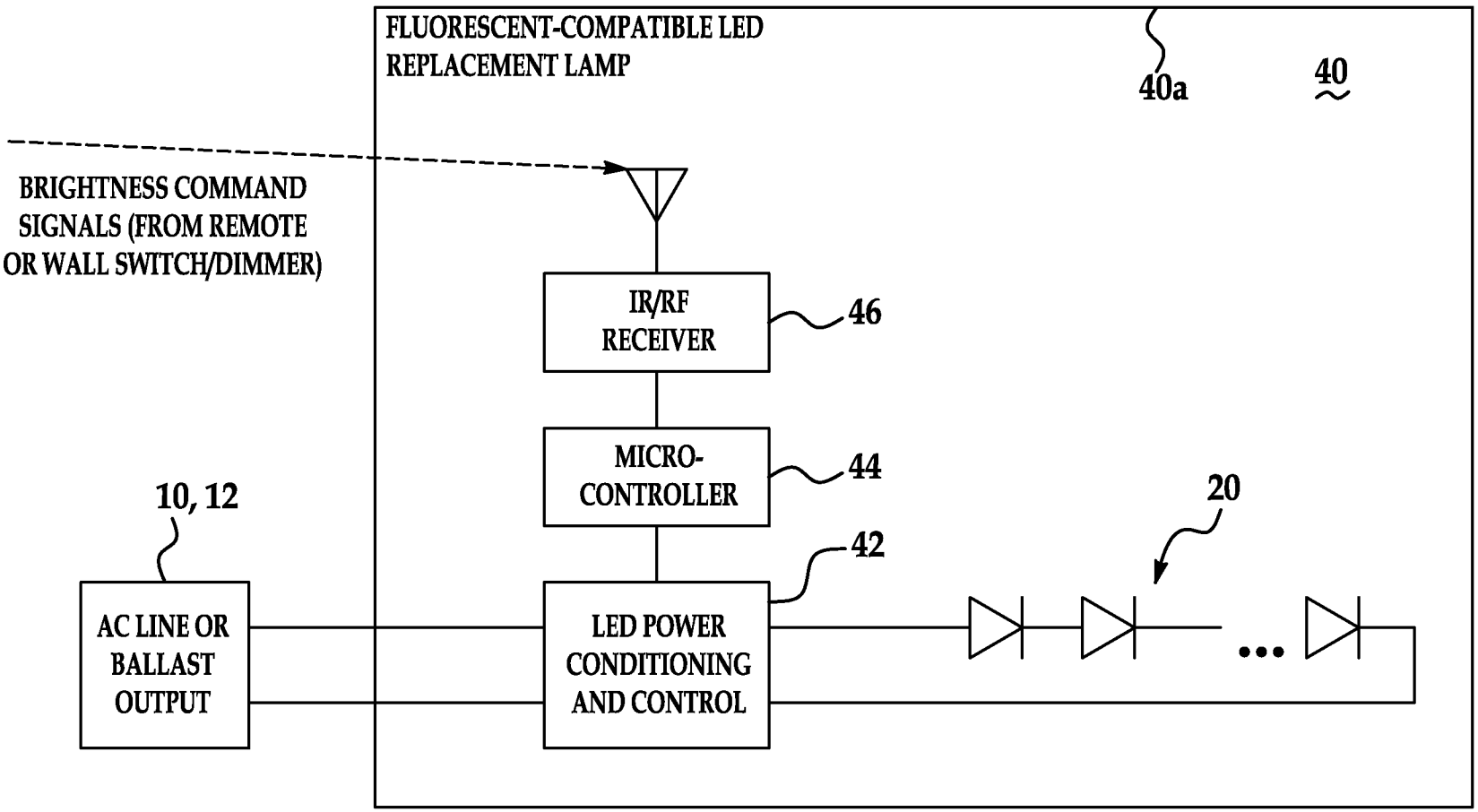
FIG. 11 is a partial schematic view of one embodiment of a dimmable LED lamp in which embodiments of the invention can be incorporated.
Figure 12:
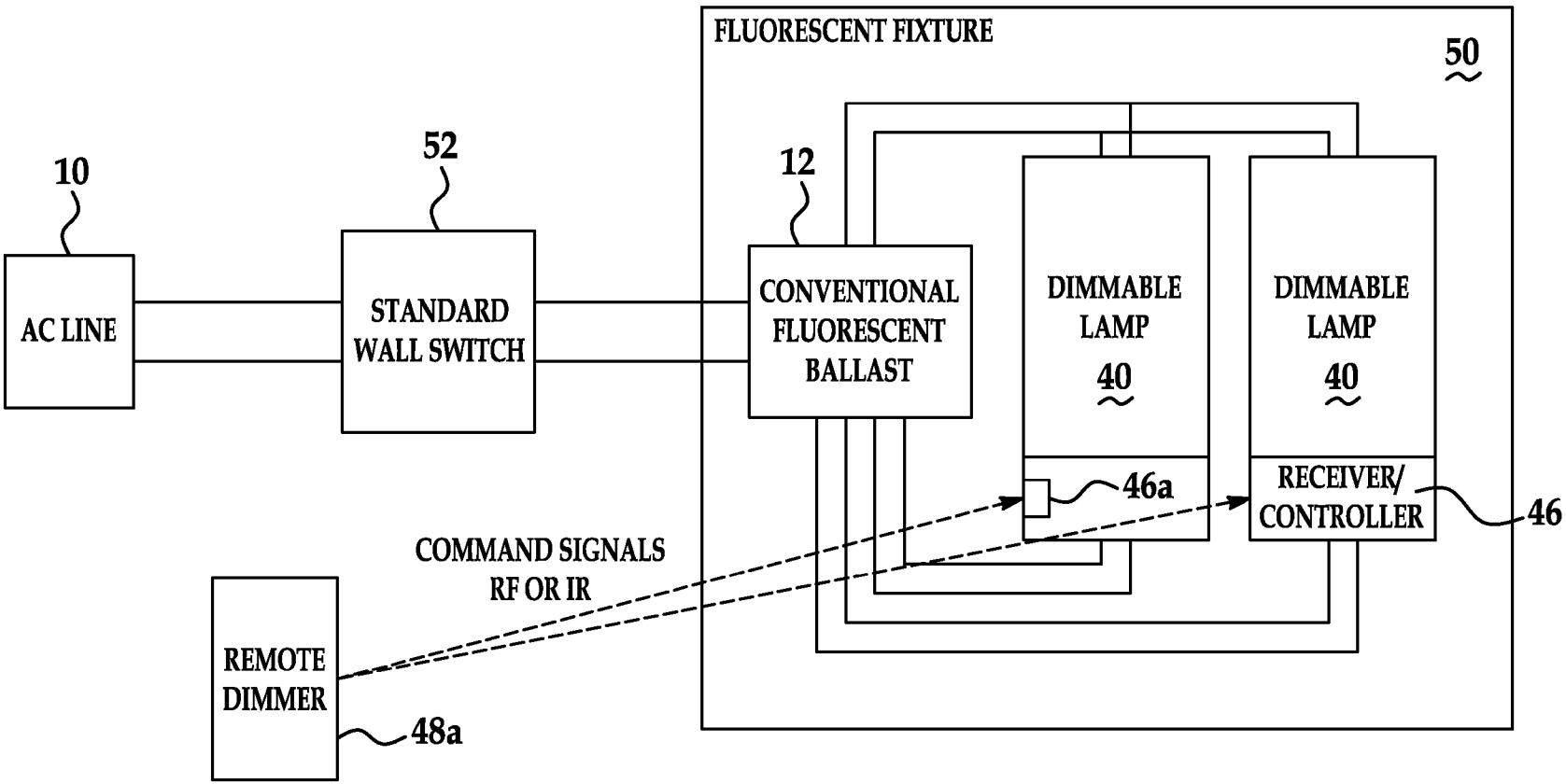
FIG. 12 is a partial schematic view of one embodiment of a fluorescent fixture incorporating a dimmable LED lamp according to FIG. 12.
Figure 13:
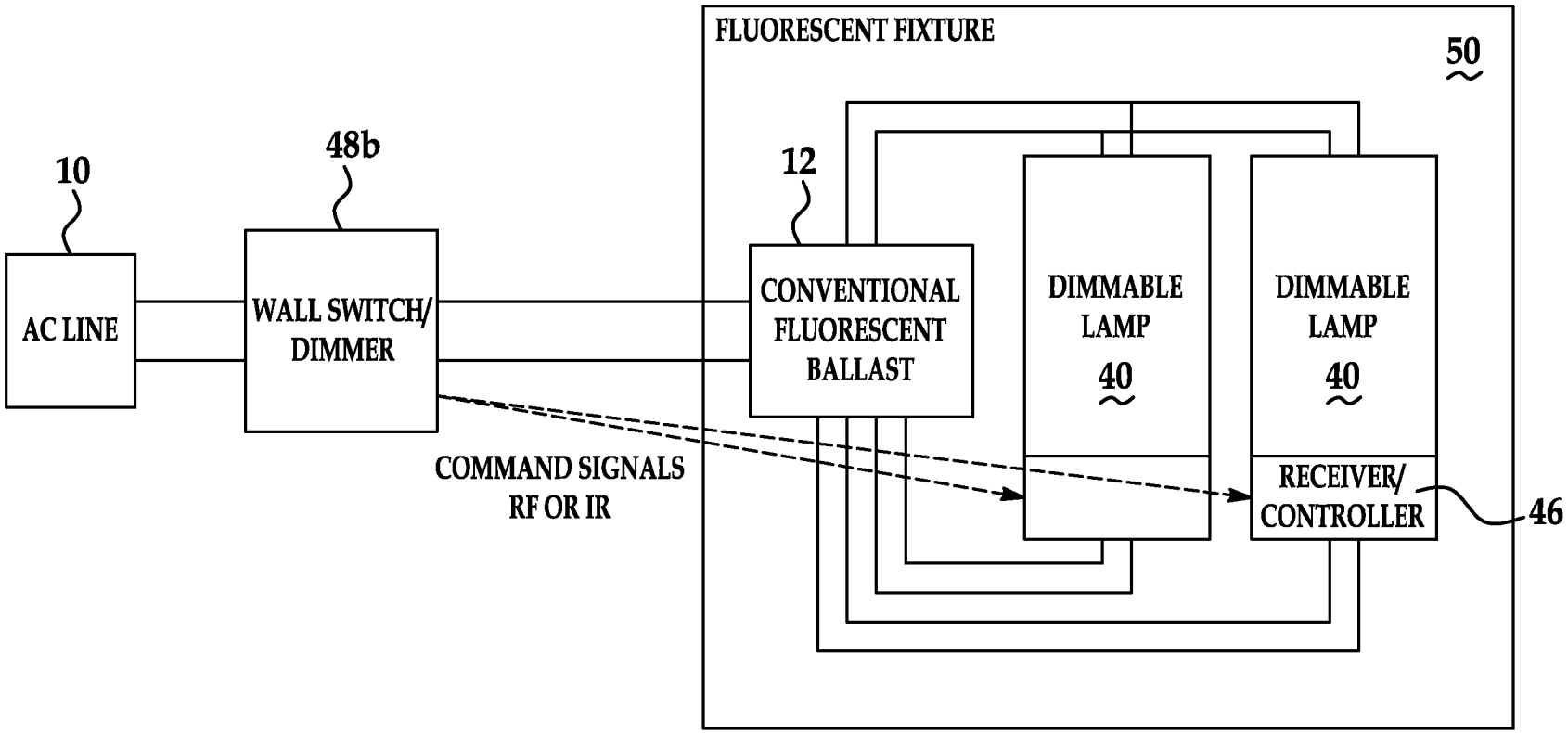
FIG. 13 is a partial schematic view of another embodiment of a fluorescent fixture incorporating a dimmable LED lamp according to FIG. 12.

FIGS. 11-13 show examples of a LED lamp 40 for fluorescent lamp replacement with integral remote dimming control. LED lamp 40 is connected to ballast 12 or AC line input 10. The LED light source, here LED 20, is coupled to a LED power conditioning and control circuit 42, which can be, for example, either of circuits 18 or 36 or their equivalent. The dimming circuit is implemented in FIG. 11 by a microcontroller 44, discussed in additional detail hereinafter. LED lamp 40 also includes an infrared (IR) or radio (RF) remote control signal receiver 46 including an antenna.

As shown in FIGS. 12 and 13, a remote dimmer may be a handheld remote 48*a* similar to a TV remote, or may be a replacement for a wall switch 48*b*, which transmits a signal that is related to the desired brightness level. The signal is received by the remote control receiver 46 in the LED lamp 40, is decoded and is used to control the power level of LED 20. In the embodiment shown, the decoding and control circuit uses a microprocessor such as microcontroller 44, but analog and non-microprocessor digital implementations are also possible.

Microcontroller 44 is shown as a separate device providing a control signal to LED power conditioning and control circuit 42 in FIG. 11, specifically to control system 28 of feedback circuit 26. However, the functions of microcontroller 44, namely receiving a signal from receiver 46, decoding that signal and transmitting a signal controlling the power level of LED 20, can be implemented with control system 28.

In the IR remote implementation, IR receiver 46 is placed within LED lamp 40, with an IR sensor 46*a* pointing out through the portion of a housing 40*a* used to emit light from LED 20. If LED lamp 40 emits light from more than one surface of housing 40*a*, such as from two sides of a circuit board upon which LED 20 is mounted, in order to receive IR remote signals from all sides, the implementation may use multiple IR sensors to ensure a clear view of the signal from remote 48*a*.

LED 20 preferably comprises white LEDs. Since white LEDs have relatively little IR output, interference between illumination LED 20 and the IR link should be minimal. However, to minimize the chances of interference, the IR control frequency should not be near the PWM dimming control frequency.

The RF remote implementation can use any of a wide variety of RF remote technologies. Where LED lamp 40 is a replacement for a fluorescent light tube, for example, any required antenna can be incorporated integrally with the circuit board for the controller 42, 44 and LED 20 because the LED lamp 40 is long. Such a replacement is shown by example in U.S. Pat. No. 7,049,761, which is incorporated herein in its entirety by reference.

As shown in FIGS. 12 and 13, multiple dimmable LED lamps 40 can be incorporated into a single fluorescent fixture 50. Fixture 50 is turned on and off by a standard wall switch 52 or the combined wall switch/dimmer 48*b*, thus providing power to conventional fluorescent ballast 12 and the remainder of the control circuitry. One remote dimmer, either from the handheld remote 48*a* or from one 48*b* integrated with a wall switch, can be used to control each LED lamp 40.

Alternatively, since lamp power controller 44 is modulating the LED output, it is possible to make the modulation of the visible light from lamp 40 contain control information to be received and acted on by other lamps 40. In that way, all the lights in a room can be controlled by pointing the remote at one lamp 40. That lamp 40 could in turn transmit the control information to yet other lamps 40. Individual lamps 40 could be addressed using digital coding as is known in the art.

Further, one or more infrared emitting diodes either separate from or incorporated in LED 20 could be used to relay commands from one lamp 40 to others in the area.

Currently, most white LEDs frequently have an undesirable color shift when operated at DC currents less than the design point of the LED. Accordingly, dimming is provided in one embodiment through on-off switching of LED 20 at a frequency above that which will be perceived by the viewer's eye. The perceived brightness will increase with increased duty cycle of the LED, while the color remains constant since when the LED is on, it is on at full brightness.

When the lamp is fitted with LED 20 designed to have a desirable color shift during operation at various DC currents, control can alternatively be implemented by regulating a substantially DC current at various levels to provide dimming.

It is preferred in certain embodiments incorporating a microcontroller 44 or other microprocessor that the desired dimming level be stored in a non-volatile manner so that if power to the LED lamp 40 or fixture 50 is turned off at wall switch 52, 48*b*, the desired dimming level is restored once power is restored. Optionally, the system may restore the brightness to full if AC power is cycled, or if a specified sequence of power is applied.

While the invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. In an illumination device including light-emitting diodes, an alternating current input, a full-wave rectifier coupled to the alternating current input and configured to produce a rectified voltage output and a power converter, the power converter having a switching element electrically coupled to the rectified voltage output of the full-wave rectifier, an improvement comprising:

a feedback circuit configured to determine an average current across the light-emitting diodes and to invert a signal representing the average current to provide a switching signal to the switching element such that, for a range of operating points, increasing a current drawn into the power converter will decrease LED power and decreasing the current drawn into the power converter will increase LED power.

2. The device of claim 1 wherein the alternating current input comprises a ballast for a fluorescent bulb.

3. The device of claim 2, further comprising:

protection circuitry electrically coupled between the ballast and the full-wave rectifier.

4. The device of claim 1, wherein the light-emitting diodes are coupled to the rectified voltage output of the full-wave rectifier and the single switching element is a low-side switch electrically coupled between the light-emitting diodes and a sense resistor.

5. The device of claim 4, further comprising:

an inductor in series with the light-emitting diodes and located between the light-emitting diodes and a connection point of the low-side switch and the light-emitting diodes.

6. The device of claim 5, further comprising:

a diode in series with the inductor and the light-emitting diodes and electrically coupled to the rectified voltage output, a diode located between the connection point and the rectified voltage output.

7. The device of claim 4 wherein the current sensed by the sense resistor is a peak current occurring when the low-side switch is closed.

8. The device of claim 1 wherein the feedback circuit is configured to calculate the average current from the peak current obtained from at least one of a sense resistor and the emitted light output.

9. The device of claim 1 wherein the feedback circuit comprises a pulse width modulator and a control system for the pulse width modulator, the control system including an input coupled to the rectified voltage output and a second input coupled to a sense resistor.

10. The device of claim 1 wherein the single switching element is a high-side switch connected between the rectified output voltage and the light-emitting diodes.

11. The device of claim 10, further comprising:

an inductor connected in series with the light-emitting diodes at a connection point between the light-emitting diodes and the high-side switch; and wherein a sense resistor is connected in series with the inductor and the light-emitting diodes and is coupled to ground.

12. The device of claim 11, further comprising:

a diode connected to a connection point between the high-side switch and the inductor such that the recirculation diode is reverse-biased when the high-side switch is closed; and wherein the recirculation diode is in parallel with the light-emitting diodes.

13. The device of claim 11 wherein the feedback circuit comprises a pulse width modulator and a control system for the pulse width modulator, the control system including a first input coupled to the rectified voltage output and a second input coupled to a sense resistor.

14. The device of claim 1, further comprising:

a remote signal receiver configured to receive a remote signal indicating a desired brightness level for the light-emitting diodes; and a dimming circuit responsive to the remote signal receiver and configured to provide a control signal to the feedback circuit indicating the desired brightness level.

15. The device of claim 14, wherein the remote signal receiver comprises one of an infrared receiver and a radio frequency antenna.

16. The device of claim 1, wherein feedback circuit is configured to output a duty cycle with a value greater than the duty cycle used to achieve a maximum value of current through the light-emitting diodes.

17. A method of controlling a feedback circuit for an illumination device having at least one LED and a power converter with a switching element;

determining an average current across the at least one LED;

inverting a signal representing the average current such that, for a range of operating points, increasing a current drawn into the power converter will decrease LED power and decreasing the current drawn into the power converter will increase LED power; and providing the switching signal to the switching element.

* * * * *